US008410415B2

(12) United States Patent
Nakamura et al.

(10) Patent No.: US 8,410,415 B2
(45) Date of Patent: Apr. 2, 2013

(54) ION DETECTOR FOR MASS SPECTROMETRY, METHOD FOR DETECTING ION, AND METHOD FOR MANUFACTURING ION DETECTOR

(75) Inventors: Megumi Nakamura, Tama (JP); Yoshiro Shiokawa, Hachioji (JP); Qiang Peng, Fuchu (JP)

(73) Assignee: Canon Anelva Corporation, Kawasaki-shi, Kanagawa (JP)

( * ) Notice: Subject to any disclaimer, the term of this patent is extended or adjusted under 35 U.S.C. 154(b) by 24 days.

(21) Appl. No.: 13/279,081

(22) Filed: Oct. 21, 2011

(65) Prior Publication Data

US 2012/0097847 A1 Apr. 26, 2012

Related U.S. Application Data

(63) Continuation of application No. PCT/JP2009/058462, filed on Apr. 30, 2009.

(51) Int. Cl.
*H01J 43/06* (2006.01)
*H01J 43/10* (2006.01)
*H01J 40/06* (2006.01)

(52) U.S. Cl. ..... 250/207; 250/296; 250/397; 250/399; 313/528; 313/532; 313/533; 313/535; 313/537

(58) Field of Classification Search ..... 250/207, 250/296, 397, 399; 313/528, 532, 533, 535, 313/537
See application file for complete search history.

(56) References Cited

U.S. PATENT DOCUMENTS 5,420,476 A * 5/1995 Nakamura et al. ..... 313/537
5,426,299 A 6/1995 Nakagawa et al. ..... 250/281
5,446,275 A * 8/1995 Sakai et al. ..... 250/207
5,481,158 A * 1/1996 Kato et al. ..... 313/533
5,532,551 A * 7/1996 Kyushima et al. ..... 313/533
6,025,590 A 2/2000 Itoi ..... 250/281

(Continued)

FOREIGN PATENT DOCUMENTS

JP 3-289037 12/1991
JP 6-267497 9/1994

(Continued)

OTHER PUBLICATIONS

Ohmura Takayuki, et al., "Detector of mass spectrometer-secondary electron multiplier", J. Vac. Soc. Jpn., Vacuum vol. 50, No. 4, pp. 258-263 (2007) (with partial English Translation).

(Continued)

*Primary Examiner* — Nikita Wells
(74) *Attorney, Agent, or Firm* — Fitzpatrick, Cella, Harper & Scinto

(57) ABSTRACT

The present disclosure provides an ion detector for improving the effect of electric field for pulling in an ion to be detected to a first-stage electrode of a secondary electron multiplier (SEM), and improving the effect of a stray light reduction. In one example embodiment, an ion detector includes a SEM, and a lead-in electrode for pulling in an ion to a first-stage electrode side of the SEM. At least one of the area of the lead-in electrode and a potential difference between the lead-in electrode and neighboring electrodes of the lead-in electrode, the neighboring electrode being an electrode not of the SEM, is set so that the light amount of internal-stray light generated inside the detector entering the first-stage electrode is not more than that of external-stray light generated outside the detector entering the first-stage electrode, when an ion is introduced into the detector.

11 Claims, 26 Drawing Sheets

U.S. PATENT DOCUMENTS

| | | | | |
|---|---|---|---|---|
| 6,737,644 | B2 | 5/2004 | Itoi | 250/292 |
| 2010/0243884 | A1 | 9/2010 | Shiokawa et al. | 250/282 |
| 2012/0024075 | A1 | 2/2012 | Peng | 73/724 |

FOREIGN PATENT DOCUMENTS

| | | |
|---|---|---|
| JP | 8-7829 | 1/1996 |
| JP | 8-138621 | 5/1996 |
| JP | 10-188878 | 7/1998 |
| JP | 2001-351565 | 12/2001 |
| JP | 2002-329474 | 11/2002 |

OTHER PUBLICATIONS

International Preliminary Report and Written Opinion dated Dec. 22, 2011 in PCT/JP2009/058462 (with English Translation of Written Opinion).

* cited by examiner

ION DETECTOR FOR MASS SPECTROMETRY, METHOD FOR DETECTING ION, AND METHOD FOR MANUFACTURING ION DETECTOR

CROSS-REFERENCES TO RELATED APPLICATIONS

This application is a continuation application of International Application No. PCT/JP2009/058462, filed Apr. 30, 2009. The contents of the aforementioned applications are incorporated herein by reference in their entities.

TECHNICAL FIELD

The present invention relates to an ion detector and a method for detecting an ion detecting a mass-selected ion with an extremely high S/N (a signal/noise ratio) in mass spectrometer, and a method for manufacturing an ion detector.

BACKGROUND ART

The mass spectrometer is an analyzer capable of measuring the abundance for every mass number of sample components, and has such large characteristic as extremely high sensitivity (low detection limit) as compared with other analyzers. One of elements realizing this is a unit (an ion detection unit) detecting a mass-selected ion, which includes a secondary electron multiplier (SEM), a deflection board, a collector etc. The SEM has electrodes of around 20 stages, to which a voltage is applied in sequence from the first-stage electrode (D1) to the final-stage electrode with a potential difference of around 100 V to 200 V. In many cases, respective voltages are supplied by dividing an applied voltage to the first-stage electrode D1 by a resistance inside the SEM. To the electrode D1, −1.5 kV to 3 kV is applied, against which mass-selected ions collide with an energy corresponding to the potential thereof. When 2 kV is applied to the electrode D1, a collisional energy is approximately 2 keV, and, when the energy is at such level, electrons (secondary electrons) are generated on the surface of the electrode D1. That is, on the electrode D1, ion/electron conversion is performed. The yield (efficiency) is around 0.1 to 0.2, and is influenced little by the material and state of the surface of the electrode D1. However, it depends on the collision energy, and is generally proportional to the collision energy E. Therefore, the energy of the ion is important for the ion/electron conversion.

The electron generated from the electrode D1 is pulled in the second stage electrode (D2) having a potential higher (in the plus direction) by around 100 V than that of the electrode D1, and collides with an energy of around 100 eV corresponding to the potential difference. The yield of the generation of secondary electrons by an electron collision is very high, and, in the energy at such level, is around 1.5 to 2.0 in an appropriate surface state. Accordingly, the amplification of the electron is realized here. After that, the electron amplification is performed in the same manner on the third-stage electrode D3 and the fourth-stage electrode D4. On the final-stage electrode, the amplification of 5 digits to 6 digits can be performed (see Patent Documents 1 to 3, Non-patent Document 1). The SEM capable of performing such extremely high amplification is an indispensable unit for the mass spectrometry.

However, to the ion detection unit (the ion detector), not only ions to be detected that are mass-selected and become signal, but also light causing noise arrives. On the electrode D1, the light is also converted to an electron, and, therefore, the light entering the electrode D1 being the first-stage electrode is amplified on the electrode D2 and subsequent electrodes, as is the case with the signal. Consequently, no matter how an amplification factor is made higher, S/N (a signal/noise ratio) is not improved to lead to meaningless. For a mass spectrometer, measurement of sample components having concentration difference of 5 to 6 digits is expected, and, for this, S/N of 6 digits is necessary. Therefore, how suppress the noise dominates decisively the performance.

In order to perform mass fractionation, first, a neutral molecule to be measured needs to be made into an ion (be ionized). A representative ionization method is called an electron ionization, in which a thermal electron of around 70 eV at an ion source is collided against a neutral molecule and an outer-shell electron is flicked to give an ion (in addition, there are several methods such as using a plasma in place of the thermal electron). However, many molecules not ionized but exited are generated in this course, which, after a little, emit light (an electromagnetic wave of around several to 50 eV: vacuum ultraviolet light) and stabilize. The vacuum ultraviolet light has no charge, and, therefore, reaches the ion detection unit without being fractionated by the mass spectrometer. If the light is irradiated as it is to the first-stage electrode D1 of the SEM, an electron (also referred to as a photoelectron because it is caused by light) is emitted. The efficiency thereof is, although strongly dependent on the surface state, approximately 0.1 (0.01 to 0.2). That is, electrons are generated with efficiency nearly equal to that of ions being the original signal.

Moreover, such probability is known that light causing the noise is also emitted from the mass spectrometer. In the most representative quadrupole mass spectrometer, against a quadrupole pole having a negative high voltage, an ion collides to generate light (an electromagnetic wave of around 50 eV to 2 keV: soft X ray) having an energy higher than that of vacuum ultraviolet light. FIG. 9 shows an aforementioned situation.

FIG. 9 is a drawing schematically showing a conventional mass spectrometer.

In FIG. 9, a mass spectrometer 1 disposed in a vacuum vessel 1*a* includes an ion source 2, a mass fractionation part 3, and an ion detection unit 4.

The ion source 2 has a filament 5, uses thermal electrons 6 generated by the filament to ionize neutral molecules including a molecule of a measurement object, and introduces generated ions into the mass fractionation part 3.

The mass spectrometer 3 has quadrupole electrodes 7 including four column-shaped electrodes. Among quadrupole electrodes 7, electrode sets facing each other are electrically coupled and, to respective electrode sets, a direct-current voltage and a high-frequency alternating-current voltage are applied to cause only ions having a mass number corresponding to respective voltages, frequencies etc. to pass in the long axis direction of the quadrupole electrode 7.

The ion detection unit 4 has a deflection board 8 functioning as an electrode for curving the trajectory of ions, and a secondary electron multiplier (SEM) 9. In FIG. 9, the secondary electron multiplier 9 has electrodes D1 to D20 of 20 stages (20 pieces), and a collector 10. To the ion introduction part of the ion detection unit 4 at a former stage in the deflection board 8, a mass aperture board 11 in which an aperture is formed is provided. The mass aperture board 11 is set to have a predetermined potential, and usually has the ground potential (the earth potential, 0 V).

In such constitution, when ions generated in the ion source 2 enter the mass fractionation part 3, an ion 13 having a desired mass number passes through the mass fractionation part 3, and the ion 13 enters the ion detection unit 4. The ion 13 having entered the ion detection unit 4 changes the trajectory thereof toward the electrode D1 side by the action of the deflection board 8. When the ion 13 enters the electrode D1, on the electrode D1, an electron is generated by ion/electron conversion. When the electron enters the electrode D2, on the electrode D2, secondary electrons 12 are generated, and the secondary electrons 12 are amplified sequentially on subsequent electrodes D3 to D20 to enter the collector 10. The collector 10 outputs a signal 15 in accordance with entered secondary electrons.

In such mass spectrometry, as described above, in addition to ions, vacuum ultraviolet rays 15 may enter the mass fractionation part 3 from the ion source 2. Moreover, by the collision of an ion 16 against the quadrupole electrode 7, soft X rays 17 may be generated.

The vacuum ultraviolet light and the soft X ray thus generated cause the noise for the mass spectrometer, and are called "stray light." Since the stray light dominates largely the basic performance of the mass spectrometer, the ion detection unit is devised so as to detect an original ion alone and not to detect the stray light as far as possible, but sufficient performance is not necessarily given.

[Patent Document 1] Japanese Patent Laid-Open No. 2002-329474

[Patent Document 2] Japanese Patent Laid-Open No. 10-188878

[Patent Document 3] Japanese Patent Laid-Open No. 2001-351565

[Non-patent Document 1] Ohmura Takayuki, Yamaguchi Haruhisa, "Detector of mass spectrometer-secondary electron multiplier," J. Vac. Soc. Jpn., Vacuum Vol. 50, No. 4, P 258-263 (2007)

SUMMARY OF INVENTION

In order not to detect the stray light, the ion detection unit is devised as follows. FIG. 10 is a drawing showing a part of a mass spectrometer of a first conventional example, and is an enlarged view near an entrance of the ion detection unit 4 shown in FIG. 9.

The mass aperture board 11 is usually set to be the ground potential (the earth voltage, 0 V), and the ion detection unit 4 detects the ion 13 having passed therethrough. If the detection of an ion alone is considered, placing the electrode D1 being the first-stage electrode of the secondary electron multiplier 9 on the same axis as the mass aperture board 11 is effective, but, in the arrangement, the stray light 18 including at least one of the vacuum ultraviolet ray and the soft X ray is detected inevitably. Accordingly, the first conventional example has such construction that the trajectory of the ion is curved by the deflection board 8, and that the ion 13 is detected by the electrode D1 arranged, sifted from the axis in the long axis direction of the quadrupole electrode 7. To the electrode D1, a negative high potential such as around 2 kV is applied, and the original ion 13 to be detected is detected without considerable loss by the pull-in electric field and an electric field generated by a potential of several tens volts applied to the deflection board 8. On the other hand, since the stray light 18 with no charge goes straight on and scarcely reaches the electrode D1. This structure is widely prevalent as the Off-Axis structure.

However, since the stray light has such high reflectivity as around 0.2 and is emitted from the mass aperture board 11 in a scattered state to some degree, the reduction effect of the stray light 18 by the first conventional system is around one digit.

An ion detection unit that improved this reduction effect is shown in FIG. 11 as a second conventional example. In FIG. 11, the unit has basically an Off-Axis structure, but the electrode D1 is placed farther away to reduce more the arrival of the stray light 18. Moreover, in order not to reduce as far as possible the detection efficiency of the original ion 13 to be detected, an electrode 19 for pulling in the ion 13 by an electric field (hereinafter, also called a "lead-in electrode") is newly disposed and, to the lead-in electrode 19, the same negative high potential as that applied to the electrode D1 is applied. In the structure according to the second conventional example shown in FIG. 11, the effect of the stray light 18 that is proportional generally to inverse-square of the interval is reduced. However, nevertheless the "lead-in electrode 19" has been disposed, as compared with the first conventional example, the pull-in electric field near the mass aperture board 11 becomes weaker, and the original ion 13 to be detected reaching the electrode D1 has also reduced. Consequently, the S/N has not become of sufficient performance, yet.

A further improved ion detection unit is shown in FIG. 12 as a third conventional example. In FIG. 12, between the first deflection board 8*a* to which a potential of ±several tens V is applied, and the mass aperture board 11, a second deflection board 8*b* to which a potential of ±several tens V is applied is provided. Accordingly, the electrode D1 itself is less likely of the Off-Axis, but, since the second deflection board 8*b* and the lead-in electrode 19 are provided between the mass aperture board 11 and the electrode D1 as obstacles, it is made so that the electrode D1 can not directly seen (not seen through) from the mass aperture board 11. Accordingly, the influence of the stray light 18 is remarkably reduced. Moreover, similarly to the second conventional example, the lead-in electrode 19 having the same potential as that of the electrode D1 is disposed, trying to ensure the detection efficiency of the original ion 13 to be detected. However, there is such problem that the pull-in effect for the original ion to be detected is reduced because the electric field of the lead-in electrode 19 does not extend to the vicinity of the mass aperture board 11.

For example, since ions ejected from the mass spectrometer 3 such as a quadrupole mass spectrometer have a large spread in the energy in directions lateral to the position (directions perpendicular to the axis), it has become important to apply a strong electric field so as to cause ions to converge and proceed to an intended direction, for detecting efficiently original ions to be detected. With regard to the ion pull-in effect, first conventional example>second conventional example>third conventional example, which is a result conflicting with the effect of stray light reduction.

The invention is achieved in view of such problems, and a purpose thereof is to provide an ion detector capable of improving the effect of the electric field for pulling in ions to be detected to the first-stage electrode of a secondary electron multiplier and of improving the effect of reducing the stray light, a method for detecting an ion, and a method for manufacturing an ion detector.

A first aspect of the invention is an ion detector, comprising: a secondary electron multiplier having a first-stage electrode generating an electron by collision of an ion, and a rear-stage electrode generating a secondary electron amplified by collision of the electron generated from the first-stage electrode; a deflecting electrode changing a trajectory of an ion toward the first-stage electrode side; and a lead-in electrode for pulling in the ion the trajectory of which is changed by the deflecting electrode toward the first-stage electrode side, wherein the lead-in electrode has at least one opening so that an area to which internal stray light generated inside the ion detector or external stray light generated outside the ion detector is incident becomes small. A second aspect of the invention is an ion detector including a secondary electron multiplier having a plurality of electrodes, and a lead-in electrode for pulling in ions to a first-stage electrode side of the secondary electron multiplier, wherein at least one of the area of the lead-in electrode and a potential difference between the lead-in electrode and neighboring electrodes thereof, the neighboring electrode excluding electrodes of the secondary electron multiplier, is set so that a light amount entering the first-stage electrode of internal stray light generated inside the ion detector becomes not more than a light amount entering the first-stage electrode of external stray light generated outside the ion detector, when an ion is introduced into the ion detector.

A third aspect of the invention is a method for detecting an ion, including the steps of: mass-fractionating incident ions and introducing the same into an ion detector, pulling in the introduced ion to the first-stage electrode side of a secondary electron multiplier by an electric field by a lead-in electrode, and converting the pulled in ion to an electron on the first-stage electrode and amplifying the converted electron, wherein at least one of the area of the lead-in electrode and a potential difference between the lead-in electrode and neighboring electrodes thereof, the neighboring electrode excluding electrodes of the secondary electron multiplier, is set so that a light amount entering the first-stage electrode of internal stray light generated inside the ion detector becomes not more than a light amount entering the first-stage electrode of external stray light generated outside the ion detector, when an ion is introduced into the ion detector. A fourth aspect of the invention is a method for manufacturing an ion detector including a secondary electron multiplier having a plurality of electrodes, and a lead-in electrode for pulling in an ion to a first-stage electrode side of the secondary electron multiplier, the method including the steps of: measuring each of a light amount entering the first-stage electrode of internal stray light generated inside the ion detector, and a light amount entering the first-stage electrode of external stray light generated outside the ion detector, and, on the basis of the measurement result, setting at least one of the area of the lead-in electrode and a potential difference between the lead-in electrode and neighboring electrodes thereof, the neighboring electrode excluding electrodes of the secondary electron multiplier, so that a light amount of the internal stray light entering the first-stage electrode becomes not more than a light amount of the external stray light entering the first-stage electrode, when an ion is introduced into the ion detector.

According to the invention, a lead-in electrode for pulling in an ion to a first-stage electrode side of a secondary electron multiplier is provided, and an area of the lead-in electrode and/or a potential difference between an electrode (for example, deflection board etc.) neighboring the lead-in electrode but being separated from electrodes of the secondary electron multiplier (for example, electrode D1 etc.) and the lead-in electrode is set so that the effect by internal stray light (described later) becomes equivalent to or less than the effect by external stray light (described later). Accordingly, it is possible to ensure an effect of an electric field for pulling in an ion to be detected to the first-stage electrode (ion pull-in effect), and to improve the effect of stray light reduction.

DESCRIPTION OF EMBODIMENTS

Figure 1A:
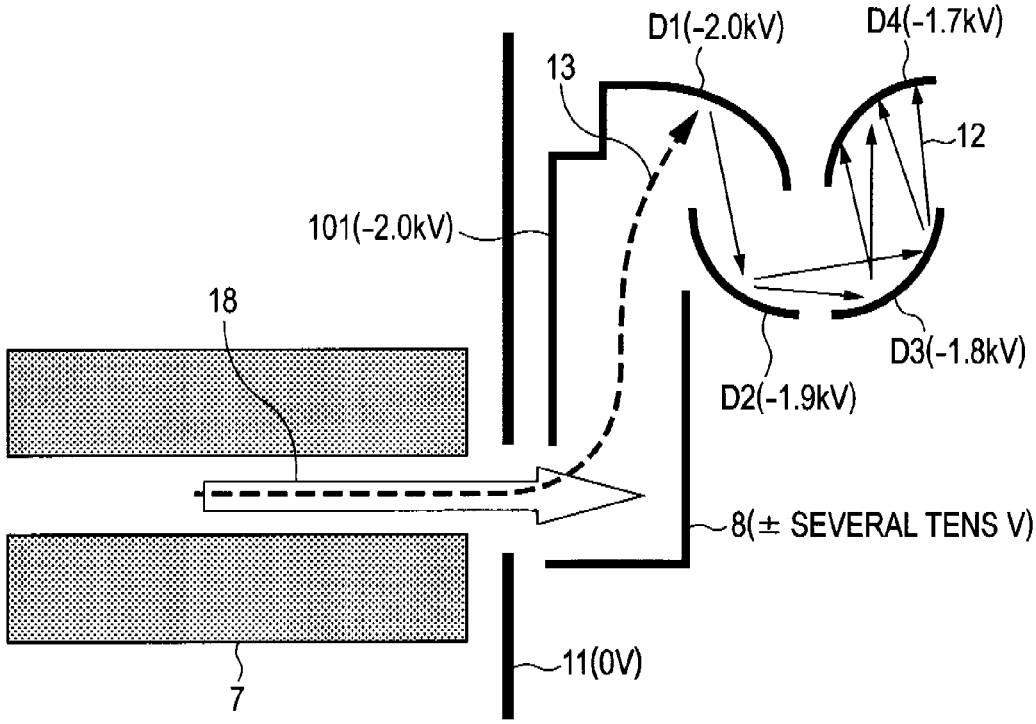
FIG. 1A is a drawing showing a part of a mass spectrometer according to an embodiment of the invention, and is a schematic view for explaining an ion analyzer.

Hereinafter, embodiments of the invention are explained in detail with reference to the drawings. Meanwhile, in drawings explained below, the same reference numeral is given to members having the same function, and repeated explanation thereof is omitted.

(Matters Examined When Practicing the Invention)

As described above, in order to improve the ion pull-in effect and the effect of stray light reduction, in an embodiment of the invention, the electrode D1 being the first-stage electrode of the secondary electron multiplier is disposed away from the aperture of the mass aperture board, and one end of the lead-in electrode is extended to the vicinity of the aperture. The ion detection unit realizing such constitution is shown in FIG. 13 as an examination example.

Figure 13:
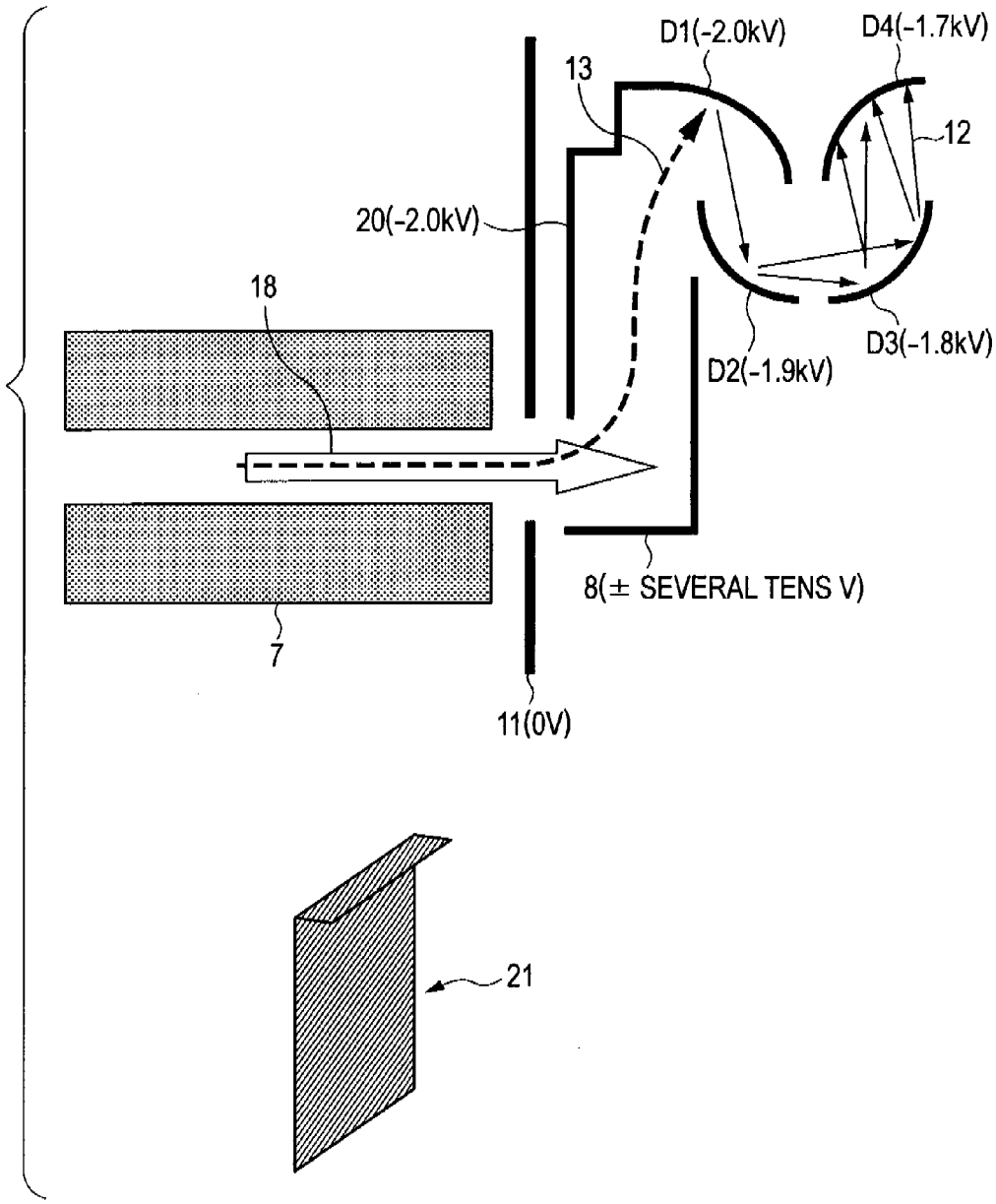
FIG. 13 is a drawing showing schematically a part of a mass spectrometer according to an embodiment of the invention.

In FIG. 13, the electrode D1 is disposed away from the aperture formed for the mass aperture board 11, in order to reduce the arrival of a stray light 18 to the electrode D1. Moreover, one end of a lead-in electrode 20 is connected to the electrode D1, and, to the lead-in electrode 20, a potential of −2.0 kV, which is the same potential as that of the electrode D1, is applied. Furthermore, by placing the other end of the lead-in electrode 20 in the vicinity of the edge of the aperture, the lead-in electrode 20 is extended to the close vicinity of the aperture. Meanwhile, in FIG. 13, a reference numeral 21 denotes the lead-in electrode 20 shown in a perspective manner.

As described above, in the examination example of the invention, the position of the electrode D1 is set to be large not only in the distance from the mass aperture board 11 but also in an angle of view (opening angle from the central axis), that is, of an extreme Off-Axis, and the lead-in electrode 20 having the same potential as that of the electrode D1 is configured to be long to reach the close vicinity of the mass aperture board 11. Consequently, the remarkable reduction of the influence of the stray light 18 and the securement of the detection efficiency of the original ion 13 to be detected can be achieved. On the other hand, the area of the lead-in electrode 20 becomes considerably large.

As described above, the examination example shown in FIG. 13 has such effective structure as capable of securing the ion pull-in effect by the lead-in electrode 20 extended to the vicinity of the aperture, and capable of reducing the arrival of the stray light 18 to the electrode D1 to reduce considerably the noise caused by the stray light. That is, while disposing far the electrode D1 in order to reduce the arrival of the stray light, it is possible to secure the ion pull-in effect by the lead-in electrode 20 extended to the vicinity of the aperture formed for the mass aperture board. Consequently, without the necessity of providing a member functioning as a screen for the stray light 18 such as the second deflection board 8*b* functioning as a screen for stray light as in the third conventional example, while improving the effect of stray light reduction, the improvement of the ion pull-in effect can also be realized.

In such useful examination example, if the noise caused by the stray light can further be reduced, a very useful ion detector having a further improved S/N ratio can be realized. That is, it is considered that the above-mentioned examination example has a desirable structure, but noise is still detected, and further reduction thereof is strongly expected.

(Principle of the Invention)

As a cause of still remaining noise due to the stray light, there is such possibility that diffused reflection/multiple reflection inside the ion detection unit allows the stray light to finally reach the electrode D1. However, as the result of performing many evaluations/experiments about the examination example, a cause other than this was found out.

As a first characteristic experimental result, the higher the potential of the electrode D1, the more the noise. Obviously, when the potential of the electrode D1 is made higher, the amplification factor increases, but, even when the increased amount was canceled, the noise amount had a strong dependency on the electrode D1 potential. Consequently, this may be a phenomenon connected with the lead-in electrode 20 having the same potential as that of the electrode D1.

A second characteristic result was that noise decreased when a negative high potential was applied to the deflection board 8 while fixing the potential of the electrode D1. The change situation was complementary to the dependency on the electrode D1 potential of the first experimental result (approximately coincident when using the potential difference as a variable).

In the original ion detection, the voltage of the deflection board 8 shows a sharp change having a peak at several tens V, but the noise changes in a clearly different manner. Since the electrode D1 lies on the way ahead between the deflection board 8 and the lead-in electrode 20 facing each other, both the deflection board 8 and the lead-in electrode 20 may be involved in this. These results can never be explained by a mechanism of conventional forms in which the stray light enters directly the electrode D1.

Therefore, as the result of hard studies, the inventor of the present application presumed the existence of a cause of a following mechanism.

Figure 14A:
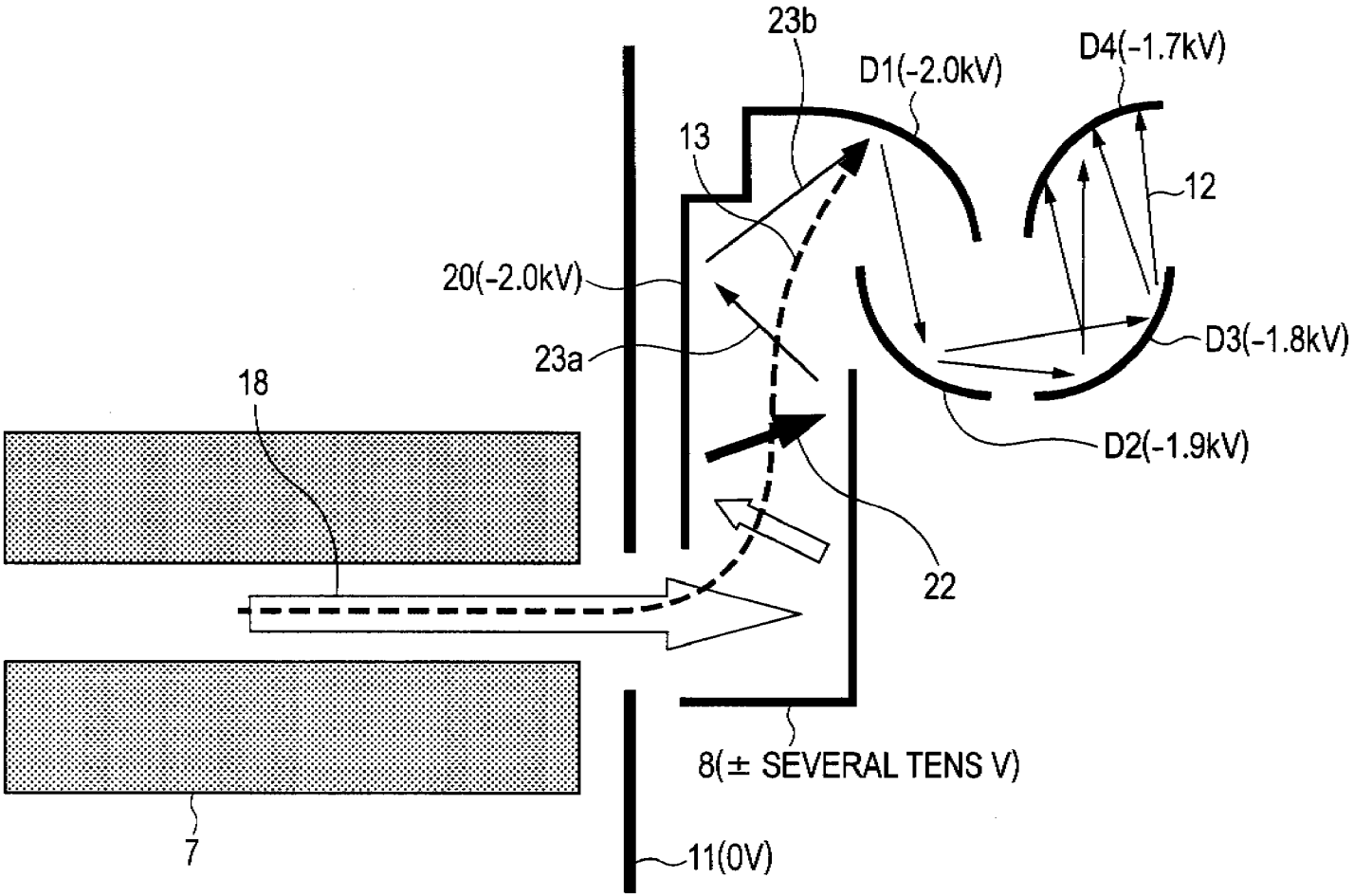
FIG. 14A is a drawing for explaining a mechanism in which the stray light causes noise in the mass spectrometer shown in FIG. 13.
Figure 14B:
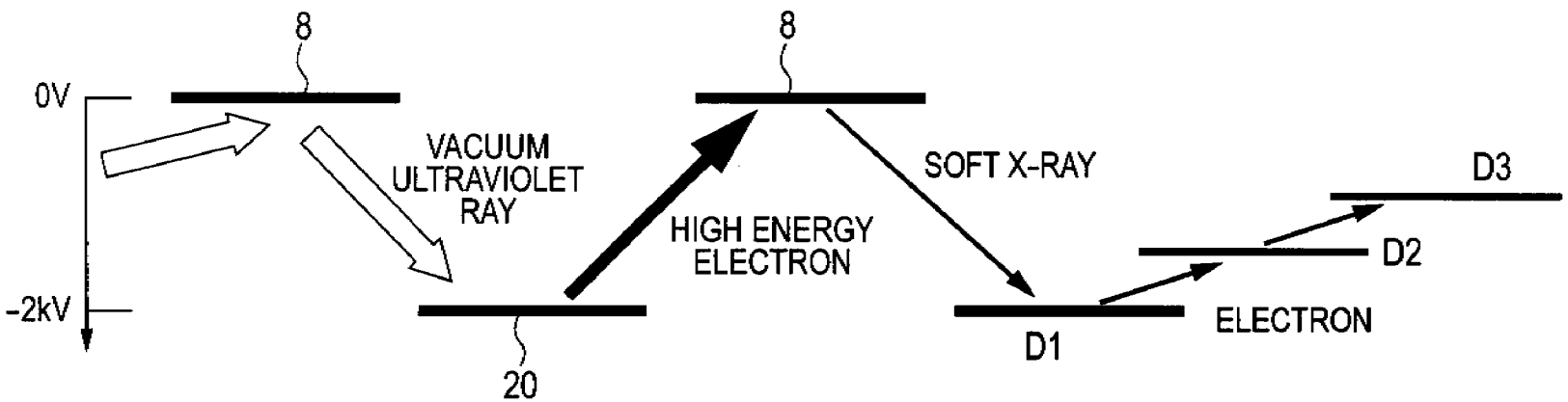
FIG. 14B is a drawing for explaining a mechanism in which the stray light causes noise in the mass spectrometer shown in FIG. 13.

In FIG. 13, since the stray light 18 is irradiated not only to the electrode D1, but also to the lead-in electrode 20, from the lead-in electrode 20, an electron (photoelectron) is emitted as is the case for the electrode D1. The electron is guided by a strong electric field between the lead-in electrode 20 and another electrode facing it such as the deflection board 8, and is irradiated to the another electrode such as the deflection board 8 with an energy (around 2 keV) corresponding to the potential difference between both. The energy of this level will cause electron light conversion to generate soft X ray on another electrode such as the deflection board 8. When the soft X ray is irradiated directly or through reflection to the electrode D1, electrons (photoelectrons) are emitted and amplified as is the case for the vacuum ultraviolet light. That is, according to conventional understanding, there is only stray light→photoelectron (@ electrode D1), but, in view of the above-mentioned phenomenon, the invention estimates a cause according to a mechanism (a mechanism found newly in the invention; hereinafter, called also a "new mechanism") of stray light→high energy electron (@ lead-in electrode)→soft X ray (@ another electrode such as the deflection board)→photoelectron (@ electrode D1). The new mechanism can explain the above-mentioned experimental result. FIGS. 14A and 14B show an explanatory view of the mechanism.

As shown in FIGS. 14A and 14B, when the stray light 18 is reflected from the deflection board 8 and enters the lead-in electrode 20, a high-energy electron 22 is generated, and the high-energy electron 22 collides against the deflection board 8 to generate a soft X ray 23*a*. The soft X ray 23*a* is reflected from the lead-in electrode 20. In FIG. 14A, a reference numeral 23*b* denotes the reflected soft X ray. When the soft X ray 23*b* enters the electrode D1, noise due to the stray light 18 is generated.

This phenomenon may just occur when the lead-in electrode has a negative high potential. Of course, electrons are emitted from the deflection board and other electrodes/inner walls with nearly the ground potential to which the stray light is irradiated. But, in the vicinity thereof, no high potential more positive than the ground potential exists, and thus the electrons never have a high energy not to generate a problem. Accordingly, it has no probability to be a cause in the first conventional example, but, in the constitution having a lead-in electrode with a negative high potential such as not only in the examination example as an embodiment of the invention but also in the second and third conventional examples, it always has a probability of being a cause.

A similar phenomenon is reported as a soft X-ray limit for an ionization vacuum gauge, although it belongs to a separated field. Here, electrons from a filament collide against a grid with around 100 eV, and the soft X rays generated here irradiate a collector. From the collector, electrons are emitted to form a pseudo ion current, and, therefore, the lower limit of the original ion current measurement is determined. As a countermeasure for this, the area of the collector is made smaller to reduce the irradiation efficiency of the soft X rays. When correlating it with the above-mentioned cause (the new mechanism) estimated in the invention, it becomes high-energy electrons (@ lead-in electrode/filament)→soft X rays (@ deflection board/grid)→photoelectrons (@ D1/collector). But, there are such differences that the generation source of the high-energy electron is photoelectrons by vacuum ultraviolet light in the invention but is thermal electrons from a filament in the ionization vacuum gauge, and that the purpose of the electrode D1 is the emission of secondary electrons in the invention but the purpose of the collector is the measurement of an ion amount in the ionization vacuum gauge. Consequently, it is difficult to apply directly the improvement plan in the ionization vacuum gauge (reduction of the collector area) as the reduction plan of the cause.

In the study of the soft X-ray limit, the conversion efficiency from a high-energy electron to a photoelectron is checked. The conversion efficiency is proportional to approximately 1.6 power of the energy, and the absolute value thereof is said to be an order of $10^{-5}$ at 2 keV. From this result, it is felt that, as compared with the conventional noise of stray light→photoelectron, the noise of stray light→high-energy electron→soft X ray→photoelectron according to the new mechanism of the invention may be negligible. However, as the result of detailed examinations below, it became clear that the noise according to the new mechanism of the invention had sufficient possibility of contributing to the final S/N ratio.

The reason thereof is, in simple terms, that although the external stray light to become noise is one having finally reached the electrode D1 with difficulty after it is multiply-reflected and attenuated between another electrode such as the deflection board and the lead-in electrode, to the lead-in electrode D1, incomparably larger amount of the external stray light than the stray light finally reached is irradiated and, in addition, the light has also obtained on the way the energy corresponding to the potential difference. Hereinafter, detailed explanation is given in 1) to 4).

1) Actually, in the examination example shown in FIG. 13, first, the area of the lead-in electrode 20 is considerably large, and is even around 10 times the area of the electrode D1 (the reason why the area of the lead-in electrode is large is that, from the viewpoint of not disturbing the ion trajectory as much as possible, an electrode face is disposed over the whole ion traveling path and the length in a direction perpendicular to paper is prepared sufficiently). 2) Next, the lead-in electrode 20 exists up to the vicinity of the mass aperture board 11 being the emission source of the stray light 18, and, to a region of the lead-in electrode 20 near the mass aperture board 11, the stray light 18 with an extremely high intensity is irradiated. Because of both causes 1) and 2), the difference between the stray light finally reaching the electrode D1 and the stray light irradiated to the lead-in electrode 20 amounts probably up to several digits.

Meanwhile, the surface of the electrode D1 has been subjected to a surface treatment suitable for the emission of secondary electrons, but the effect based on it is not more than two times, and there is no large influence on the general situation even if the lead-in electrode 20 has not been subjected to a surface treatment (the difference of the surface treatment of the electrode D1 and subsequent respective electrodes has a large influence on the result of multistage amplification).

3) Moreover, the light generating photoelectrons on the electrode D1, which affects the noise, is vacuum ultraviolet light with a low energy, in the conventional mechanism. In contrast, in the new mechanism of the invention, the light generating photoelectrons on the electrode D1, which affects the noise, is soft X rays having a higher energy. 4) Furthermore, there may be a problem in applying experimental quantitative values in the ionization vacuum gauge directly to the ion detection unit different in many points such as the structure and material.

On the basis of 1) to 4) above, it is decided that the dominant noise in the examination example of the invention is generated through the new mechanism of stray light→high-energy electron (@ lead-in electrode)→soft X ray (@ another electrode such as a deflection board)→photoelectron (@ electrode D1).

Figure 10:
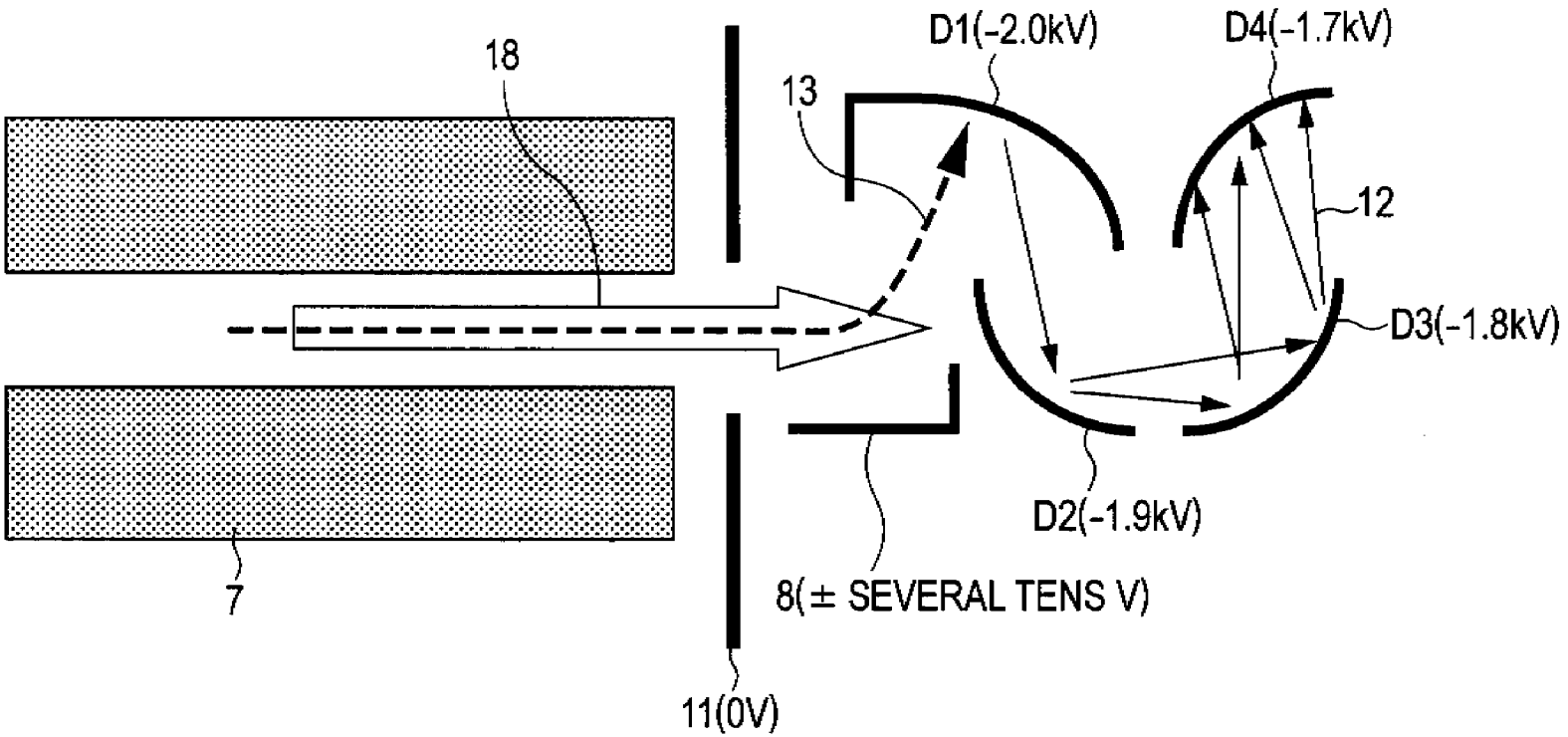
FIG. 10 is a drawing showing a part of the mass spectrometer in the first conventional example.
Figure 11:
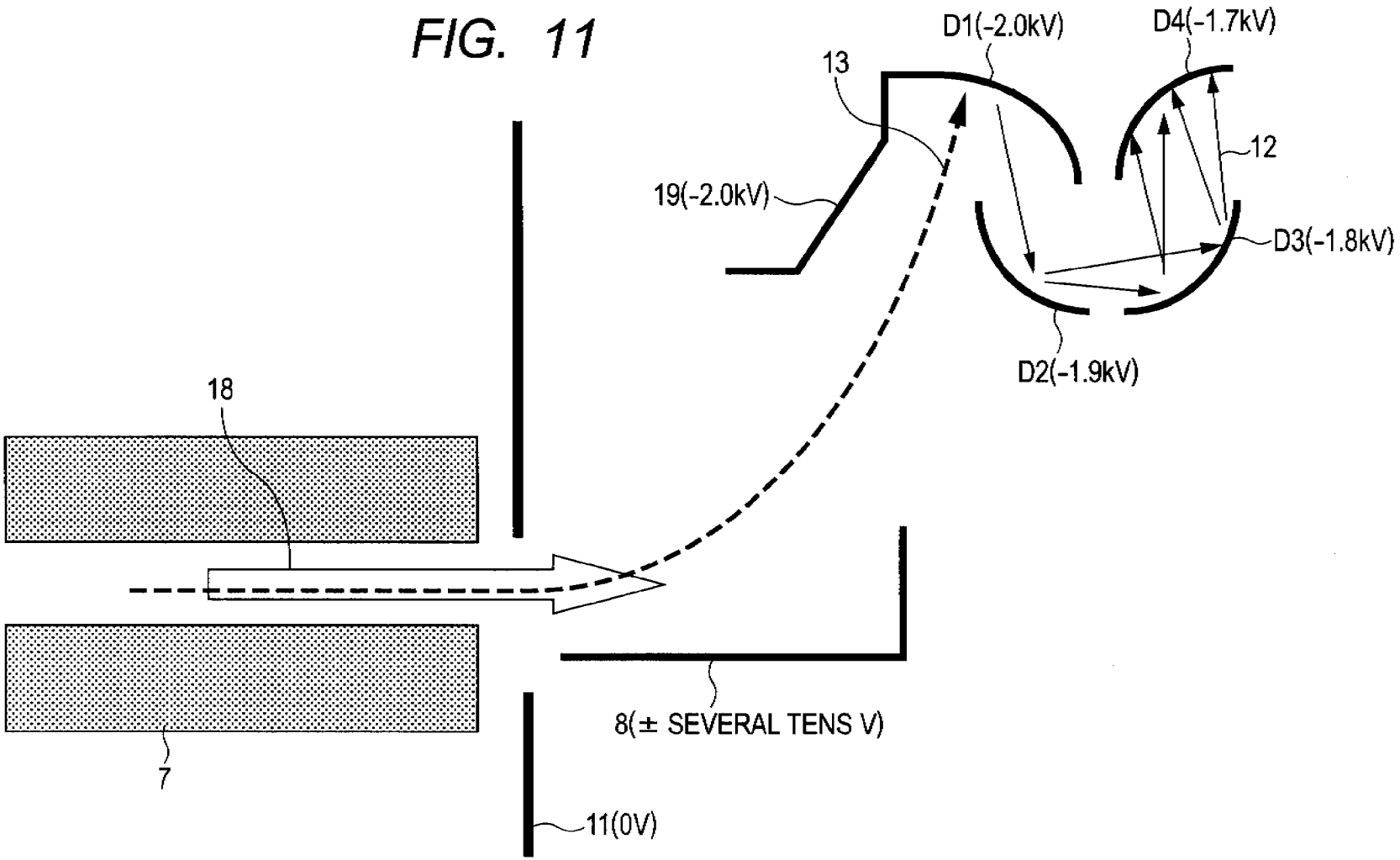
FIG. 11 is a drawing showing a part of the mass spectrometer in a second conventional example.
Figure 12:
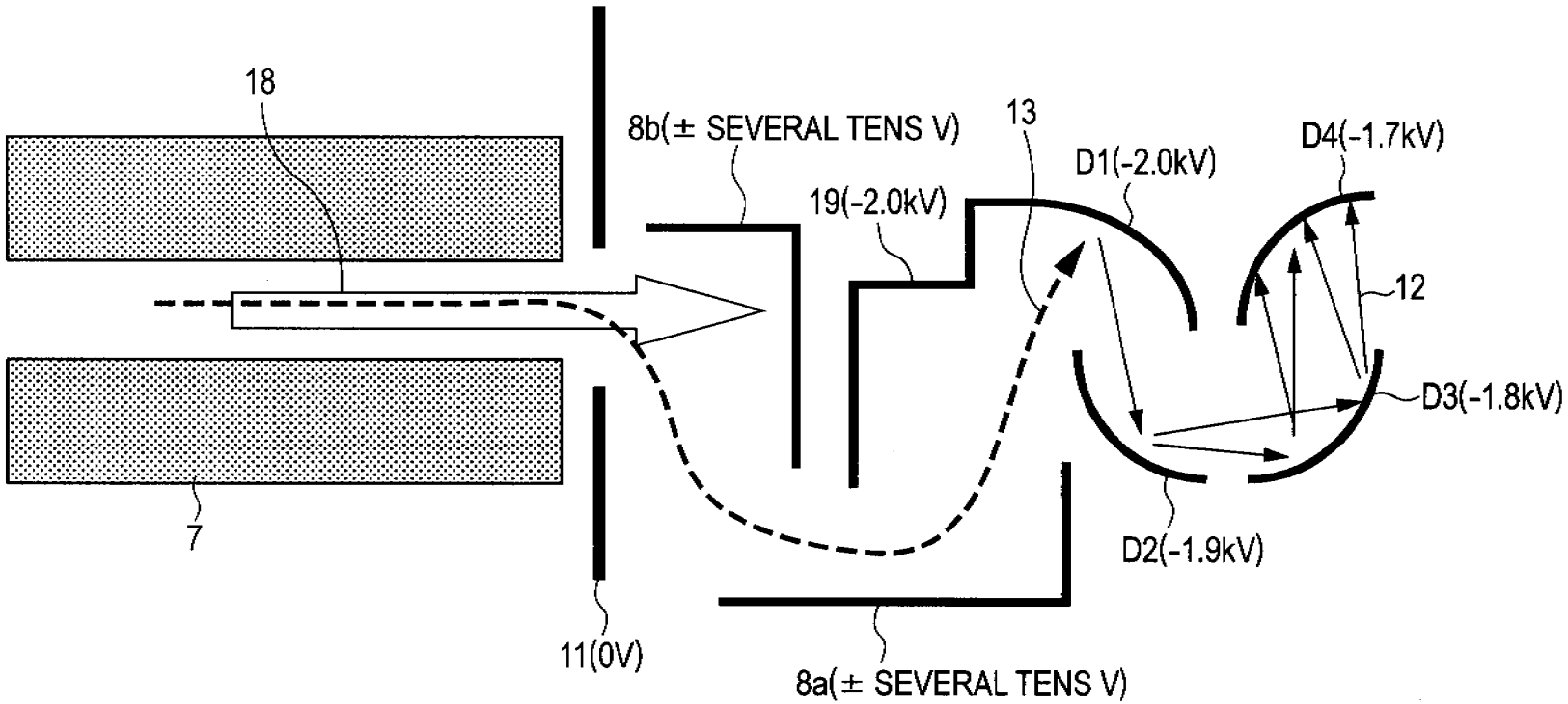
FIG. 12 is a drawing showing a part of the mass spectrometer in a third conventional example.

Meanwhile, needless to say, the above approach to the noise through the new mechanism is not limited to the examination example of the invention, but can be applied to ion detectors having an electrode for curving the trajectory of ions to the electrode D1 side (for example, the lead-in electrode), such as the first to the third conventional examples explained in FIGS. 10 to 12, for example. Because, the essence of the invention is to suppress the incidence of the internal stray light, such as soft X rays generated by the action of high-energy electrons generated on the lead-in electrode etc. inside the ion detector by the external stray light, which is described later, to the electrode D1.

Here, conventionally known stray light generated outside an ion detector (for example, the ion detection unit 4), such as an ion source and a mass spectrometer, is defined as an "external stray light." That is, in FIGS. 10 to 14, the stray light 18 is an external stray light, and a stray light entering along with ion incidence from an ion introduction part of an ion detector for introducing ions from such external apparatus as a mass spectrometer is called the "external stray light."

In addition, the stray light generated caused by the external stray light inside an ion detector, which is found newly through the invention, is defined as an "internal stray light." That is, in FIG. 14A, soft X rays 23*a* and 23*b* are included in the internal stray light, and light (for example, soft X rays) generated by high-energy electrons generated through the irradiation of the external stray light to members in an ion detector such as the lead-in electrode and the deflection board is called the "internal stray light."

In order to realize a high S/N in mass spectrometers, in addition to the "external stray light" having conventionally been estimated, the "internal stray light" newly estimated in the invention must be lowered.

In order to reduce the conventionally dominant (in particular, clearly in the first conventional example) "external stray light", the examination example of the invention uses positively the lead-in electrode 20. However, the lead-in electrode 20 generates newly the "internal stray light," and, as the result, the influence by the "internal stray light" has become larger than the influence of the "external stray light."

Accordingly, the target of the invention is to make the influence by the "internal stray light" be at least equivalent to the influence of the "external stray light," in ion detection units using the lead-in electrode. That is, the target of the invention is to make the influence of the "internal stray light" on the S/N ratio (the noise amount caused by the internal stray light) be equivalent to or less than the influence of the "external stray light" on the S/N ratio (the noise amount caused by the external stray light). This is no more than making the light amount of the "internal stray light" reaching the electrode D1 being the first-stage electrode of the secondary electron multiplier be equivalent to or less than the light amount of the "external stray light" reaching the electrode D1, in the ion introduction from an ion introduction part of an ion detector.

Meanwhile, although a strict comparison of the magnitude of the influence between the "internal stray light" and the "external stray light" is difficult, in the examination example shown in FIG. 13, there was a difference of several times to near a digit. Consequently, although the comparison of the magnitude of the influence is difficult, as an example of decision criteria, in the present situation, the difference shall be three times. And, the influence due to the "internal stray light" should be made 1/3 or less than the influence by the "external stray light." For example, a basis that the influence of the internal stray light is three times the influence of the external stray light as an example of the decision criteria is as follows. Since the noise is originally a random phenomenon, the decision of the numeral thereof with too much strictness is unreasonable and meaningless. Consequently, in an "analysis" field including the mass spectrometry, generally the minimum unit of S/N is set to be three. For example, it is so determined that S/N>3 is a condition allowing detection (presence or absence determination), S/N>10 is a condition allowing quantitative measurement, and S/N>30 is a condition allowing good quantitative measurement. That is, to make the difference be three times leads to the enhancement of the S/N level by one step.

Meanwhile, in a constitution of a certain ion detector, when estimating the difference of the influence of the internal stray light relative to the influence of the external stray light to be X times (X; a number larger than one), a guiding principle of the invention is to make the influence by the "internal stray light" on the S/N ratio be 1/X or less than the influence by the "external stray light" on the S/N ratio.

In the invention, it is important to set the area of the lead-in electrode or the potential difference between the lead-in electrode and neighboring electrode thereof (for example, the deflection board), the neighboring electrode excluding electrodes of the secondary electron multiplier (electrodes D1 to D20), is set so that the influence by the internal stray light on the S/N ratio becomes smaller than the influence by the external stray light on the S/N ratio. In the invention, it is possible to use the above-mentioned guideline of the invention in designing the area of the lead-in electrode and the potential difference between the lead-in electrode and neighboring electrode thereof (for example, the deflection board), the neighboring electrode excluding electrodes of the secondary electron multiplier. That is, when fabricating the ion detector according to an embodiment of the invention, supposedly a conventional ion detector or the examination example of the invention is used as a standard, in accordance with the apparatus constitution to be the standard, an estimated value relative to the above-mentioned numerical value according to the difference between the internal stray light and the external stray light varies. Consequently, the above-mentioned guideline of the invention is only a standard for designing in the fabrication of the ion detector of the invention supposedly on the basis of a conventional ion detector or the examination example of the invention.

Figure 9:
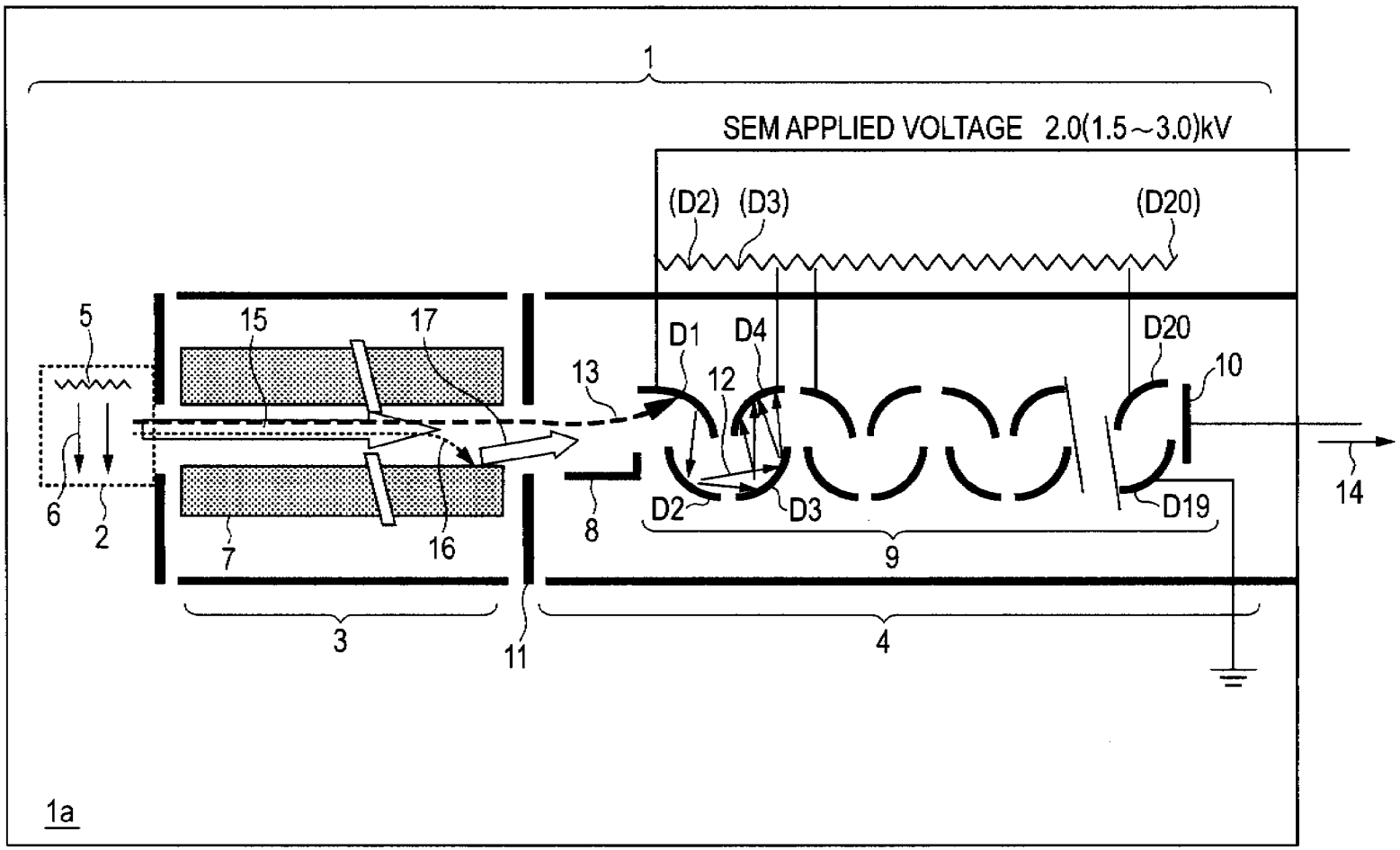
FIG. 9 is a drawing showing schematically the whole of the mass spectrometer in a first conventional example.

Here, a method for measuring the noise amount by the "external stray light" and the "internal stray light" is explained using FIG. 9. First, by a process (1) below, noises by stray light including both are distinguished from other noises (a noise of SEM itself, a noise of an electric circuit, etc.).

Process (1); after setting the voltage so that all the ions do not enter the ion detection unit 4, the filament 5 of the ion source 2 is switched OFF from ON, the difference thereof is the noise by stray light. That is, the noise including a noise by the external stray light and a noise by the internal stray light is detected by the collector 10. In order not to allow ions to enter the ion detection unit 4, there are such methods as setting the potential of an ion generation region of the ion source 2 to be lower (in negative) than the central potential of the quadrupole electrode 7, or setting the mass number to be measured to a value not owned by any component (such as m/z 5 etc.), etc.

Meanwhile, usually, since there is overwhelmingly much noise by the stray light, the process (1) is ranked as a confirmation work.

Next, in the filament ON state in the process (1), in a manner of a process (2) below, the "external stray light" is distinguished from the "internal stray light."

Process (2); when setting the potential difference between the lead-in electrode 20 and other neighboring electrodes such as the deflection board 8 to be one severalth, if possible 1/10 or less from the original value, the difference thereof is the noise by the "internal stray light," and the remaining amount is the noise by the "external stray light." That is, when the potential difference is changed to, for example, 1/10 or less, the noise by the external stray light is detected by the collector 10, and the difference between the noise detected before the change by the collector 10 and the noise detected this time by the collector 10 is the noise by the internal stray light.

This is because the influence of the "external stray light" being the course of light alone is completely not influenced by the potential change, but the noise by the "internal stray light" with an electron entering on the way depends strongly on the potential. Meanwhile, strictly speaking, since the noise by the "internal stray light" is proportional to 1.6 power of the energy, a noise of 2.5% is to be left even when the potential difference is made to 1/10, but an error of the level may be negligible. Meanwhile, in the case where the potential of the electrode D1 is changed, the amplification factor also changes, and, therefore, the contribution thereof must be eliminated.

Meanwhile, in the above-mentioned method for measuring a noise amount, the noise by the internal stray light and the noise by the external stray light are detected by the collector 10 in a state where no ion enters the ion detection unit 4. Accordingly, in the method for measuring a noise amount, each of the amount of the internal stray light and the amount of the external stray light entering the electrode D1 being the first-stage electrode of the secondary electron multiplier 9 is measured as the result. That is, in an embodiment of the invention, it is sufficient when each of the incident amount of the internal stray light and the incident amount of the external stray light at the electrode D1 can be measured in this manner.

Examples of such methods include a method of disposing a photoelectric element just in front of a face of the electrode D1 to which ions are incident, in addition to the method for measuring a noise amount. In the method, as is the case for the process (1), various voltages are set so that all the ions do not enter the ion detection unit 4. When measurement is performed in this state with the photoelectric element, the light amount of stray light including the internal stray light and the external stray light is measured. Subsequently, in the same manner as the process (2), potentials to be applied to the lead-in electrode 20 and the deflection board 8 are controlled so that the potential difference between the lead-in electrode 20 (−2 kV in FIG. 13) and the deflection board 8 (±several tens V in FIG. 13) becomes, for example, 1/10 or less. In this case, a light amount measured with the photoelectric element is the light amount of the external stray light. Accordingly, it is possible to measure the light amount of the internal stray light by calculating the difference between the light amount measured with the photoelectric element before controlling the potential difference and the light amount of the external stray light.

Any method may be used when the light amount of the internal stray light at the electrode D1 and the light amount of the external stray light at the electrode D1 at the incidence time of an arbitrary ion can be measured as described above. In an embodiment of the invention, by using such method for measuring the light amount of the internal stray light and the light amount of the external stray light, it is possible to set the area of the lead-in electrode, and the potential difference between the lead-in electrode and neighboring electrodes thereof (for example, the deflection board).

Now, the improvement plan for the "internal stray light" is determined by how reduce the "generation amount" of high-energy electrons and the "energy value" thereof.

First, for reducing the generation amount of high-energy electrons, the area reduction of the "lead-in electrode" is effective. The generation amount of high-energy electrons is proportional to an amount of received light of the stray light irradiated (the amount actually irradiated to the lead-in electrode), and the amount of received light is directly proportional to the area of the "lead-in electrode." Meanwhile, for other electrodes such as the deflection board that generates soft X rays, similar area reduction is not sufficiently effective. The reason is that high-energy electrons having a charge are attracted to other electrodes such as the deflection board by an electric force, and that, even when the collision against other electrodes such as the deflection board is avoided, eventually they collide against an electrode/inner wall of the ground potential to generate soft X rays. In contrast, since the irradiation of the stray light to the "lead-in electrode" has no attraction by an electric force and, in addition, the irradiation of the stray light to the electrode/inner wall of the ground potential does not generate a harmful high-energy electron, the area reduction of the "lead-in electrode" becomes effective.

Consequently, for example, in the examination example of the invention, when estimating that the influence of the internal stray light is three times the influence of the external stray light, the following is given. That is, when the area of the lead-in electrode 20 is made smaller than the area in the examination example, as described above, the noise by the internal stray light decreases in proportion to this. Accordingly, in such a case, it is possible to say that, when making the area of the lead-in electrode 20 in the examination example of the invention be 1/3 or less, the influence on the S/N ratio by the "internal stray light" is smaller than that by the "external stray light."

Next, for reducing the energy value of high-energy electrons, the lowering of the potential difference between the "lead-in electrode" and other neighboring electrodes such as the deflection board is effective. For example, in the examination example of the invention, when estimating that the influence of the internal stray light is three times the influence of the external stray light, the following is given. That is, since the final conversion efficiency to photoelectrons is proportional to 1.6 power, by setting the potential difference between the lead-in electrode 20 and the deflection board 8 to be smaller than that in the examination example, the noise by the internal stray light decreases in proportion to this. Accordingly, when setting the potential difference between the lead-in electrode 20 and the deflection board 8 to be 1/2 relative to the examination example shown in FIG. 13, the noise by the internal stray light decreases to 1/3 (1.6 power of 1/2), and, therefore, the "internal stray light" has a smaller influence on the S/N ratio than the "external stray light."

Hereinabove, as a new cause (the new mechanism), only stray light→high-energy electron→soft X ray→photoelectron is considered, but causes other than this may exist.

For example, first, there is a mechanism in which high-energy electrons generated on the "lead-in electrode" directly enter the electrode D1, the electrode D2, the electrode D3 etc. to be amplified. Since the electrode D1 lies in a position seen from the "lead-in electrode," electrons generated by a stray light with a comparatively high energy may have an energy allowing ejection of secondary electrons even for the potential of the electrode D1. Although the electrode D2, the electrode D3 etc. do not lie in a position that can be seen, since the reflectance of electrons is at around the same level as that of light, above-mentioned electrons may be multiply scattered as is the case for the stray light to enter the electrode D2 and the electrode D3. When entering the electrode D2 and the electrode D3, the amplification factor becomes around a half, but it is considered that the influence is larger because secondary electrons can sufficiently be generated by the potential difference.

Secondly, there is a mechanism that a stray ion, instead of vacuum ultraviolet light, collides against the "lead-in electrode" to generate a high-energy electron (after that, the same as above). The stray ion is an ion generated in an ion source and is not sufficiently fractionated (removed) with a mass spectrometer to arrive, and, when it collides against the "lead-in electrode" of a high negative potential with a high energy, an electron is generated in the same manner as the stray light.

Since both mechanisms are not largely contradictory to the above-mentioned experimental result, both may occur at the same time. Moreover, depending on the constitution/structure of the mass spectrometer or setting conditions, the degree of the influence may also change. However, these three causes are exactly the same in that they are the main cause of the generation of high-energy electrons, and countermeasures for these are approximately the same.

In an embodiment of the invention, since the lead-in electrode for pulling in ions toward the electrode D1 side by the electric field of itself is provided, it is possible to realize the Off-Axis structure for reducing the external stray light, and to cause ions to reach efficiently the electrode D1 by an ion pull-in effect. Furthermore, in an embodiment of the invention, the area of the lead-in electrode and/or the potential difference between the lead-in electrode and neighboring electrodes thereof, the neighboring electrode (for example, the deflection board) excluding electrodes of the secondary electron multiplier is set so as to reduce the influence on S/N by the internal stray light newly found in the invention. Accordingly, it is possible to reduce the effect of the internal stray light on the S/N radio conventionally completely not estimated, and to reduce further a noise caused by the stray light.

That is, in an embodiment of the invention, the essence is to reduce the influence of the internal stray light on the S/N ratio and to set it to be not more than the influence of the external stray light on the S/N ratio in the new mechanism newly found in the invention, and it is important to set the incident amount of the internal stray light to be not more than the incident amount of the external stray light at the electrode D1, when an ion is incident under a certain condition (the same condition). In the invention, by adopting the Off-Axis structure using the lead-in electrode, the reduction of the external stray light is achieved. As shown in the second conventional example, although the external stray light can further be reduced by keeping the electrode D1 away from the aperture formed for the mass aperture board 11, in any of structures for reducing the external stray light, the internal stray light is generated. That is, to what extent the external stray light is reduced, the internal stray light is generated, and the internal stray light influences larger on the noise than the external stray light. The internal stray light has not been estimated completely, but, in an embodiment of the invention, by setting the influence of the internal stray light on the S/N ratio (the incident amount of the internal stray light to the electrode D1) to be not more than the influence of the external stray light on the S/N ratio (the incident amount of the external stray light to the electrode D1), a further reduction of the noise can be achieved.

For that purpose, in an embodiment of the invention, at least one of the area of the lead-in electrode and the potential difference between the lead-in electrode and neighboring electrodes thereof, the neighboring electrode (for example, the deflection board) excluding electrodes of the secondary electron multiplier (for example, the electrode D1 etc.) is set suitable. That is, in an embodiment of the invention, at least one of the area of the lead-in electrode and the potential difference between the lead-in electrode and neighboring electrodes thereof, the neighboring electrode (for example, the deflection board) excluding electrodes of the secondary electron multiplier is set so that the light amount of the internal stray light entering the electrode D1 (the noise amount by the internal stray light) is not more than the light amount of the external stray light entering the electrode D1 (the noise amount of the external stray light), at an incidence time of an arbitrary ion.

As described above, when designing the area and the potential difference, it is necessary to measure both the incident amount of the internal stray light to the electrode D1 (the noise amount by the internal stray light), and the incident amount of the external stray light to the electrode D1 (the noise amount by the external stray light), and, for the measurement of these, the method already described may be used. As described above, by making the area of the lead-in electrode smaller, or by making the potential difference between the lead-in electrode and neighboring electrodes thereof, the neighboring electrode (for example, the deflection board) excluding electrodes of the secondary electron multiplier, smaller, the generation amount and the energy value of high-energy electrons to be the main cause of the internal stray light can be reduced. Therefore, according to the strategy, by designing the above-mentioned area or the potential difference while performing the above-mentioned measurement, it is possible to obtain the area of the lead-in electrode or the potential difference between the lead-in electrode and neighboring electrodes thereof, the neighboring electrode (for example, the deflection board) excluding electrodes of the secondary electron multiplier, that gives the light amount of the internal stray light not more than the light amount of the external stray light.

First Embodiment

Figure 1B:
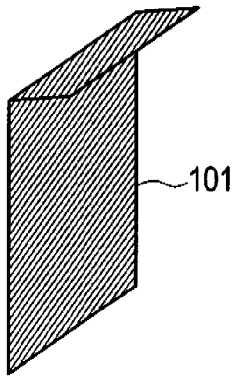
FIG. 1B is a perspective view of a lead-in electrode of the ion analyzer shown in FIG. 1A.

FIG. 1A is a schematic view showing a part of the mass spectrometer according to the embodiment of the invention, and is a schematic view for explaining an ion analysis unit. FIG. 1B is a perspective view of the lead-in electrode of the ion analysis unit in FIG. 1A.

In the embodiment, the secondary electron multiplier has 20 stage electrodes, but, in FIG. 1A, electrodes up to the fourth stage (four electrodes) are shown. In the embodiment, the electrode D1 provided at the first-stage of the secondary electron multiplier and the electrode D2 provided at the second stage are provided facing each other, and a kth electrode Dk (k is an integer of 2 or more) is provided, facing a (k−1)th electrode Dk−1 being the electrode of the previous stage thereof and a (k+1)th electrode Dk+1 being the electrode of the rear stage thereof.

That is, each of electrodes D1 to D20 is provided so that an electron generated by the collision of an ion against the electrode D1 provided for the first-stage of the secondary electron multiplier enters the electrode D2 of the rear stage to generate secondary electrons amplified on the electrode D2, and the amplified secondary electrons are caused to enter sequentially electrodes (D3 to D20) at rear stages to be amplified further. To these electrodes D1 to D20, a voltage for performing the amplification, for example, a voltage that gives a potential difference of 100 V between an electrode at the previous stage and an electrode at the rear stage is applied. That is, as shown in FIG. 1A, a potential of −2.0 kV is applied to the electrode D1, a potential of −1.9 kV is applied to the electrode D2, a potential of −1.8 kV is applied to the electrode D3, and a potential of −1.7 kV is applied to the electrode D4. To electrodes D4 to D20, potentials are applied in the same manner.

As described above, the electrode (electrode D1) lying at the first-stage among a plurality of electrodes of the secondary electron multiplier ejects an electron generated by an incident ion to the second stage electrode (D2) at the rear stage, and electrodes D1 to D20 are constituted so that each at the second and rear stages amplifies the secondary electron incident from the electrode at the previous stage and ejects the same to the electrode at the rear stage.

And, for the ion introduction part to the ion detection unit, a mass aperture board 11 having an aperture formed therein is provided, wherein the mass aperture board 11 has the ground potential (0 V). For the rear stage of the ion introduction part in the traveling direction of an ion flux incident via the aperture of the mass aperture board 11, the deflection board 8 functioning as a deflecting electrode for changing the trajectory of the incident ion flux is provided. To the deflection board 8, a potential of ±several tens V is applied, and by the potential, the traveling direction of the ion flux can be curved.

Near the entrance of ordinary ion detection unit, frequently only the secondary electron multiplier (SEM) and the deflection board are provided, but, in the embodiment, a lead-in electrode 101 is provided separately. That is, it is so provided that the lead-in electrode 101 faces the deflection board 8, and that the ion 13 passes through a region between the lead-in electrode 101 and the deflection board 8. By the electric field generated by the lead-in electrode 101, it is possible to pull in the ion 13 to the electrode D1 side and cause the ion 13 to reach the electrode D1. To the lead-in electrode 101, the same potential as that of the electrode D1 (−2 kV) is applied. Accordingly, one end of the lead-in electrode 101 can be connected electrically with the electrode D1. Since such connection makes it unnecessary to provide separately a power supply system for applying a potential to the lead-in electrode 101, such form is preferable in view of simplification of the apparatus. Moreover, by locating the other end of the lead-in electrode 20 near the edge of the aperture of the mass aperture board 11, the lead-in electrode 101 is extended to very close to the aperture. Further, in the embodiment, as shown in FIG. 1B, the lead-in electrode 101 has a mesh shape.

In such constitution, the ion 13 fractionated with the quadrupole electrode 7 and having a specified mass number is ejected from the mass aperture board 11 to the ion detection unit. The ion 13 is pulled in toward the SEM direction by the electric field (−2 kV) of the mesh-shaped lead-in electrode 101 and the electric field (several tens V) of the deflection board 8, flies between the lead-in electrode 101 and the deflection board 8, and, after that, enters the electrode D1 being the first-stage electrode of the SEM. After that, secondary electrons are ejected and amplified in the same manner according to the function of ordinary SEMs.

The constitution/construction/function of the embodiment are entirely identical to those in the examination example of the invention (FIG. 13), but the characteristic of the embodiment is that the "lead-in electrode" is formed from mesh. The transmittance of the mesh for light is 90%, and, on the other hand, for the formation of an electric field, the use of a fine mesh acts in almost the same manner as the board shape in the examination example. Accordingly, even when the mesh-shaped lead-in electrode 101 according to the embodiment is used, the detection efficiency of the original ion 13 to be detected can be maintained.

However, since in the embodiment, 90% of the stray light passes through the mesh, in the mesh-shaped lead-in electrode 101 according to the embodiment, the generation of high-energy electrons can be reduced to 1/10.

Meanwhile, the stray light having passed through the mesh-shaped lead-in electrode 101 is irradiated to the mass aperture board 11 on the rear side to generate an electron therefrom, but, since the mass aperture board 11 is set to have the ground potential, no high-energy electron is generated. When estimating that the influence by the internal stray light is three times the influence by the external stray light in the examination example, it reduces to 1/10 thereof in the embodiment. That is, in this case, the influence by the internal stray light on the S/N ratio is 3/10 relative to the influence by the external stray light on the S/N ratio, in the embodiment.

From the viewpoint of performance, since the noise is reduced by the amount of the transmittance, a larger transmittance of the mesh is favorable, and it may be enlarged up to around 99% being the mechanical limit. Meanwhile, since the electric field formed by the mesh is not necessarily sufficiently accurate, the diameter/interval of the mesh is not limited too much.

As described above, in the embodiment, since the lead-in electrode 101 has a shape of mesh, an effective area (the area of the electrode part) is reduced as compared with that in the examination example of the invention, and the area of the lead-in electrode is set, as the result, so that the incident amount of the internal stray light to the electrode D1 is equal to or less than the incident amount of the external stray light to the electrode D1.

Meanwhile, in the embodiment, the shape of the lead-in electrode 101 is set to be a mesh, but the shape is not limited to it. For example, an electrode of any structure may be used only if it has at least one opening, including, for example, an electrode having a slit formed therein, an electrode having a structure of a plurality of wires provided spaced apart from each other, etc. Because, by providing at least one opening in the lead-in electrode, the stray light entering the opening is allowed to pass through to the rear side, thereby making it possible to suppress the generation of high-energy electrons being the cause of the generation of the internal stray light by the stray light amount incident to the opening. Meanwhile, at this time, the area, number, position etc. of the opening may be suitably set so that the light amount of the internal stray light entering electrode D1 is equal to or less than the light amount of the external stray light entering the electrode D1.

Second Embodiment

Figure 2:
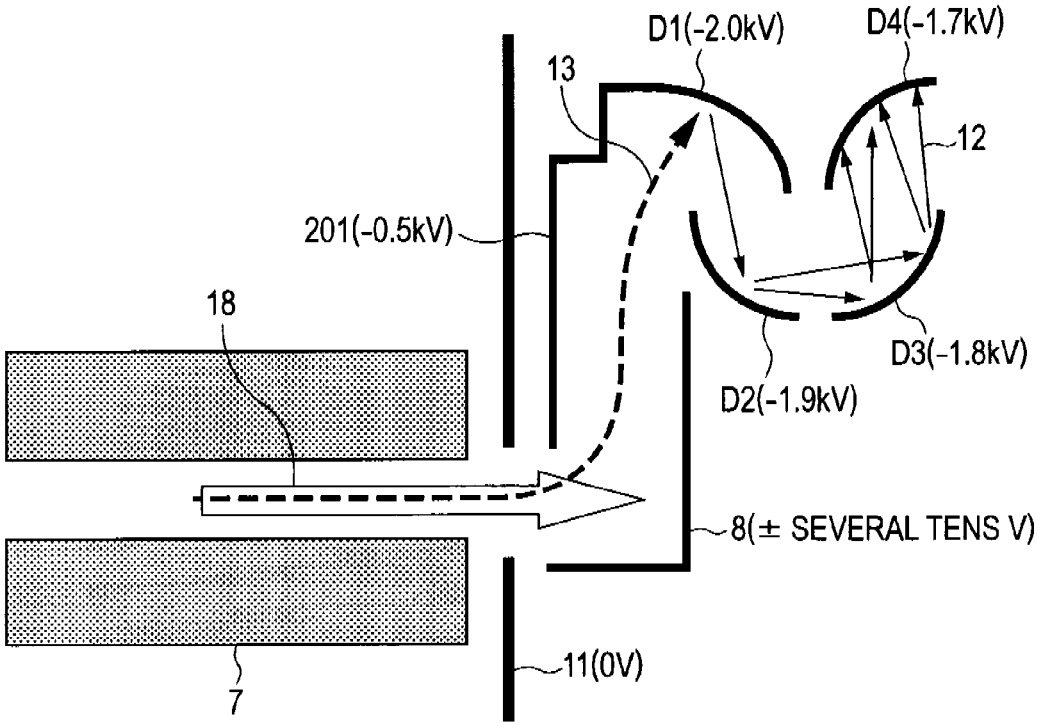
FIG. 2 is a drawing showing a part of a mass spectrometer according to an embodiment of the invention, and is a drawing for explaining an ion analyzer.

FIG. 2 is a schematic view showing a part of the mass spectrometer according to the embodiment, and a schematic view for explaining an ion analysis unit. The embodiment is different from the examination example of the invention only in that the applied potential to a lead-in electrode 201 is −500 V, and the others are the same.

In the embodiment, the ion 13 ejected from the mass aperture board 11 is pulled in toward the SEM 9 direction mainly by the electric field by the lead-in electrode 201, wherein the applied potential to the lead-in electrode for pulling in the ion is changed from −2 kV in the examination example of the invention to −500 V. Accordingly, the ion pull-in effect is reduced a little, but, when compared with the second and third conventional examples, the detection efficiency for original ions to be detected is considerably improved. And, although the amount of high-energy electrons generated on the lead-in electrode 201 is the same as that in the examination example of the invention, the energy value thereof is reduced from about 2 keV to about 500 eV. Consequently, from the relational formula that the final conversion efficiency to photoelectrons is proportional to 1.6 power of voltage as described above, a noise (N) is reduced by one digit but, in addition, a signal (S) increases.

Meanwhile, it is necessary to change the shape of other electrodes such as the lead-in electrode 201 and the deflection board 8 along with the change of the potential of the "lead-in electrode" so that the ion 13 reaches the electrode D1, but this can be known easily by the simulation of ion trajectory. For example, there are such measures as providing an end plate at the terminal on the mass aperture board 11 side of the lead-in electrode 201, and making the width of other electrodes such as the lead-in electrode 201 and the deflection board smaller wholly.

And, in the embodiment, the applied voltage to the lead-in electrode 201 is set to be −500 V, but is not limited to this, and the optimum value that gives the largest S/N can be selected freely. Here, what is important in the embodiment is to reduce the energy value of high-energy electrons generated on the lead-in electrode 201, and, for that purpose, the potential difference between the lead-in electrode 201 and the deflection board 8 being a neighboring electrode of the lead-in electrode, wherein the deflection board 8 is an electrode other than electrodes of the secondary electron multiplier 9 (electrodes D1 to D20) is set small. That is, by setting the applied potential to the lead-in electrode 201 so that the potential difference between the lead-in electrode 201 and the deflection board 8 is smaller than the potential difference between the electrode D1 and the deflection board 8, the energy value of high-energy electrons can be made smaller and the influence of the internal stray light on the S/N ratio can be made smaller, by the amount of potential difference reduced. At this time, the applied potential to the lead-in electrode 201 may be determined so that the amount of the internal stray light entering the electrode D1 is not more than the amount of the external stray light entering the electrode D1, by designing while measuring the amount of the internal stray light and the external stray light using the above-mentioned method for measuring a light amount. That is, in the embodiment, the applied potential to the lead-in electrode 201 may be any potential, only if the amount of the internal stray light entering the electrode D1 is not more than the amount of the external stray light entering the electrode D1.

Moreover, the applied potential such as 500 V to the lead-in electrode 201 can be supplied separately from the air side, but a diversion of the resistance-divided voltage in the SEM is more desirable. Because, not only it is economical, but also the ion trajectory does not change even when the applied voltage to the electrode D1 is changed by changing the multiplication factor because, following it, the potential of the lead-in electrode 201 changes at the same ratio.

Now, conventionally, for the purpose of simplification of apparatuses, it is assumed that a power supply system to the lead-in electrode and a power supply system to electrodes D1 to D20 are made same, and making the applied potential to the lead-in electrode same as the applied potential to the electrode D1 is a usual design philosophy. Accordingly, conventionally, a person skilled in the art adopts such constitution as applying the same potential to the lead-in electrode and the electrode D1 in order to apply the resistance division, under the design philosophy. As described above, conventionally, while keeping in mind to provide the lead-in electrode in a simple structure, the design philosophy is to connect electrically the electrode D1 with the lead-in electrode, and to apply the same potential to two electrodes. That is, conventionally, from a demand for simplification of apparatuses, there exists no such motivation as to apply a potential different from the applied potential to the electrode D1 to the lead-in electrode, in the field of the secondary electron multiplier. Because, when setting the applied potential to the lead-in electrode and to the electrode D1 to be identical, only by connecting the lead-in electrode with the electrode D1, a potential can be applied not only to the electrode D1 but also to the lead-in electrode, to thus realize a very simple constitution. Accordingly, in the case where an ordinary design philosophy of simplification of apparatuses is considered, since setting of the applied potential to the lead-in electrode to be different from the applied potential to the electrode D1 directs to opposite idea to the simplification of apparatuses, it is possible to say that the above-mentioned motivation does not exist in conventional technologies.

In contrast, in the embodiment, it was found that high-energy electrons generated on the lead-in electrode by the new mechanism contributed largely to the generation of the internal stray light, and that the generation of the internal stray light could be reduced by setting the potential difference between the lead-in electrode and the deflection board to be smaller. That is, the embodiment is characterized by applying a potential to the lead-in electrode, the potential having an absolute value smaller than the absolute value of the applied potential to the electrode D1, which did never exist conventionally in the above-mentioned design philosophy. Consequently, such particular effect can be exerted that the influence of the internal stray light on the S/N ratio can be made smaller, which does not exist in the above-mentioned design philosophy.

Meanwhile, in the embodiment, a potential of −0.5 kV is applied to the lead-in electrode, and a voltage of −0.5 kV is also applied to the sixteenth electrode D16 among twenty electrodes D1 to D20 of the secondary electron multiplier 9. Accordingly, by connecting electrically the electrode D16 with the lead-in electrode 201, a need for providing newly a power source for the lead-in electrode 201 disappears and the simplification of the apparatus can be secured.

Third Embodiment

Figure 3A:
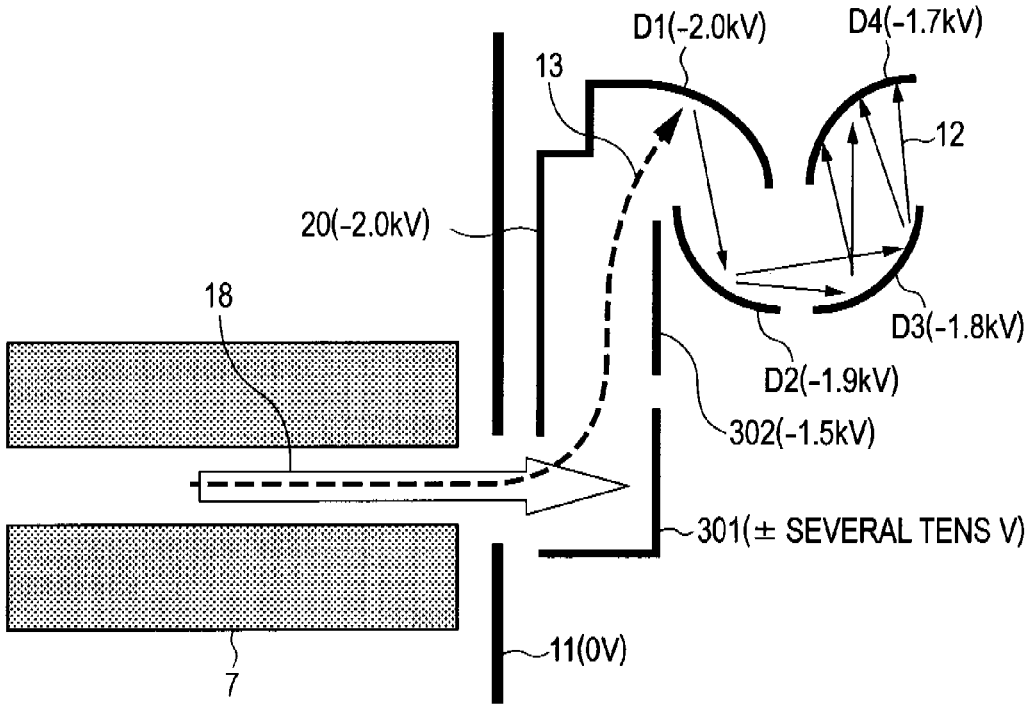
FIG. 3A is a drawing showing a part of a mass spectrometer according to an embodiment of the invention, and is a schematic view for explaining an ion analyzer.
Figure 3B:
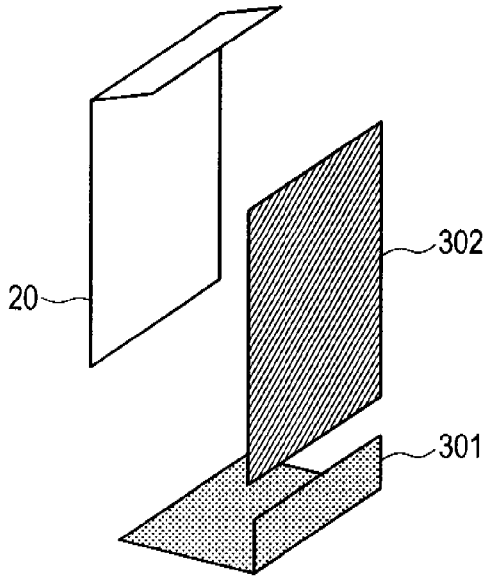
FIG. 3B is a perspective view of the lead-in electrode and the deflection board of the ion analyzer shown in FIG. 3A.

FIG. 3A is a drawing showing a part of the mass spectrometer according to the embodiment, and is a schematic view for explaining an ion analyzer. FIG. 3B is a perspective view showing the lead-in electrode and the deflection board of the ion analyzer shown in FIG. 3A. The embodiment is different from the examination example of the invention only in that the deflection board 8 is divided into two and, to a second deflection board 302 facing the lead-in electrode 20 of the deflection boards divided into two, a potential of −1.5 kV is applied, and the others are identical.

As shown in FIGS. 3A and 3B, the embodiment uses two deflection boards 301 and 302. And, to the deflection board 301 provided on the previous stage side in the traveling direction of the ion 13, a potential of ±several tens V is applied, and, to the deflection board 302 provided on the rear stage side, a potential of −1.5 kV is applied.

Most of high-energy electrons generating on the lead-in electrode 20 go toward the facing deflection board 302, but, since the applied potential to the deflection board 302 is set to be −1.5 kV instead of several tens V, the energy value of the high-energy electrons generated on the lead-in electrode 20 is reduced to about 500 eV from about 2 keV. Therefore, the noise reduction of one digit, approximately the same level as that in the second embodiment, can be expected.

Since a part of high-energy electrons colliding against places other than the deflection board 302 eject soft X rays, regarding the noise reduction, the second embodiment is slightly better, but such change in the shape of the lead-in electrode as applying the mesh construction of the SEM 9, and change in the shape of the deflection board are unnecessary. Regarding a potential of −1.5 kV applied to the deflection board 302, the diversion of the resistance-divided voltage in the SEM 9 is also desirable.

As described above, in the embodiment, it is sufficient to provide a plurality of deflection boards, and, further, to set the applied potential, so that the potential difference between at least one deflection board facing the lead-in electrode among the plurality of deflection boards and the lead-in electrode becomes a potential difference that gives the light amount of the internal stray light entering the electrode D1 not more than the light amount of the external stray light entering the electrode D1, to the lead-in electrode and the above-mentioned at least one deflection board. That is, in the embodiment, the applied potentials to the lead-in electrode and to the above-mentioned at least one deflection boards are set so that the potential difference between at least one deflection board facing the lead-in electrode (in FIG. 3A, the deflection board 302) among a plurality of deflection boards and the lead-in electrode becomes smaller than the potential difference between the deflection board at the most previous stage in the traveling direction of introduced ions (in FIG. 3A, the deflection board 301) and the electrode D1. Accordingly, it is possible to make the energy value of high-energy electrons ejected from the lead-in electrode to the above-mentioned at least one deflection board smaller, and to reduce the irradiation amount of the internal stray light to the electrode D1.

Fourth Embodiment

Figure 4:
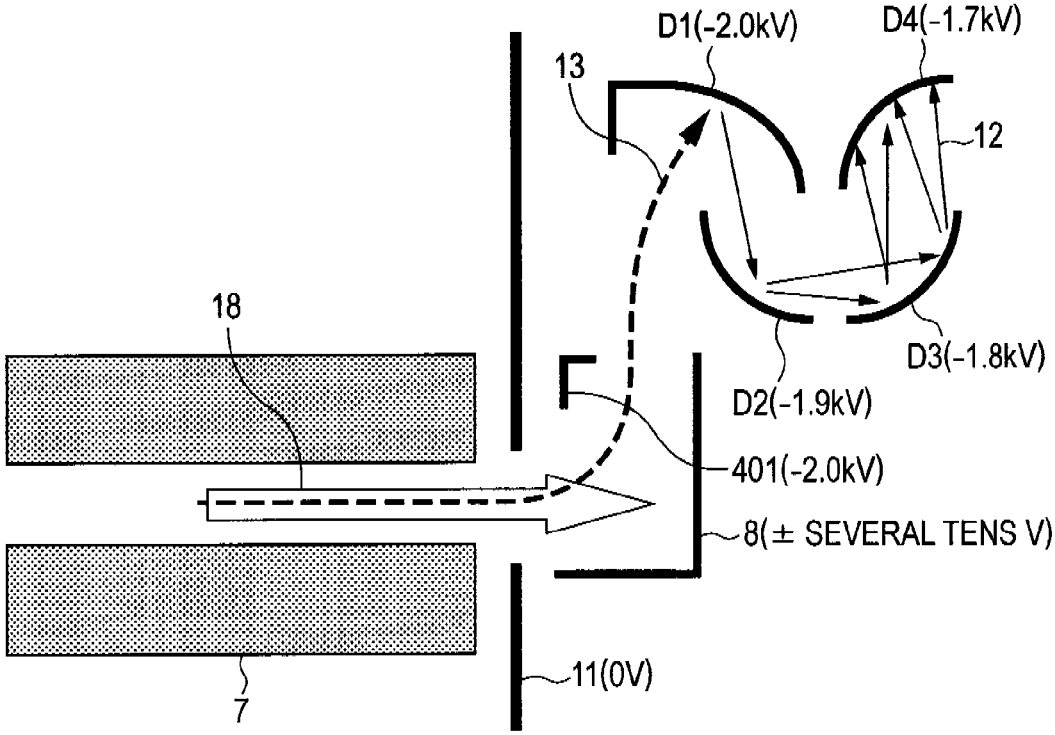
FIG. 4 is a drawing showing a part of a mass spectrometer according to an embodiment of the invention, and is a schematic view for explaining an ion analyzer.

FIG. 4 is a drawing showing a part of a mass spectrometer according to an embodiment of the invention, and a schematic view for explaining an ion analyzer. The embodiment differs from the examination example of the invention only in that the length of the lead-in electrode is made shorter to 1/4 and the area is made smaller, and the others are identical.

In FIG. 4, a lead-in electrode 401 is provided so that it is separated from the electrode D1, and that one end of the lead-in electrode 401 exists near the aperture of the mass aperture board 11. The area of the lead-in electrode 401 is reduced from the area of the lead-in electrode 20 of the examination example of the invention, and is set to be an area that gives the incident amount of the internal stray light to the electrode D1 equal to or less than the incident amount of the external stray light to the electrode D1.

Since the lead-in electrode 401 is shorter than the lead-in electrode 20 in the examination example, it is possible to reduce the irradiation amount of the stray light to the lead-in electrode and to reduce the generation of high-energy electrons, that is, the noise due to the internal stray light to 1/4. In a part where the lead-in electrode 401 does not exist between the electrode D1 and the lead-in electrode 401, the stray light is irradiated to the mass aperture board 11 on the rear to generate electrons therefrom, but, since the mass aperture board 11 is set to have the ground potential, high-energy electrons are not generated.

In the embodiment, the pull-in efficiency of ions from the mass aperture board 11 is the same as that in the first embodiment. In a part where the lead-in electrode 401 does not exist relative to the electrode D1, slight ion scattering is generated, but, since the incidence of an ion flux to the electrode D1 is sufficient, that is, the ion flux is not necessarily a micro beam, no problem occurs. But, the final detection efficiency of the ion lowers a little, the lowering is also of a degree that does not bring about a problem.

In the embodiment, since the lead-in electrode 401 is provided, separated from the electrode D1, even when the electrode D1 is provided kept away from the aperture in order to reduce further the external stray light, and the area of the extraction electrode 401 is made smaller in order to reduce the influence of the internal stray light on the S/N ratio, one end thereof can be located near the aperture (an ion introduction part) of the mass aperture board 11. As described above, in the embodiment, since the extraction electrode 401 is provided, separated from the electrode D1, and one end of the extraction electrode 401 is located near the aperture, it is possible to provide the electrode D1 kept more away from the aperture in order to reduce more the external stray light, and to suppress the incident amount of the internal stray light to the electrode D1 while securing the ion pull-in effect.

Fifth Embodiment

Figure 5A:
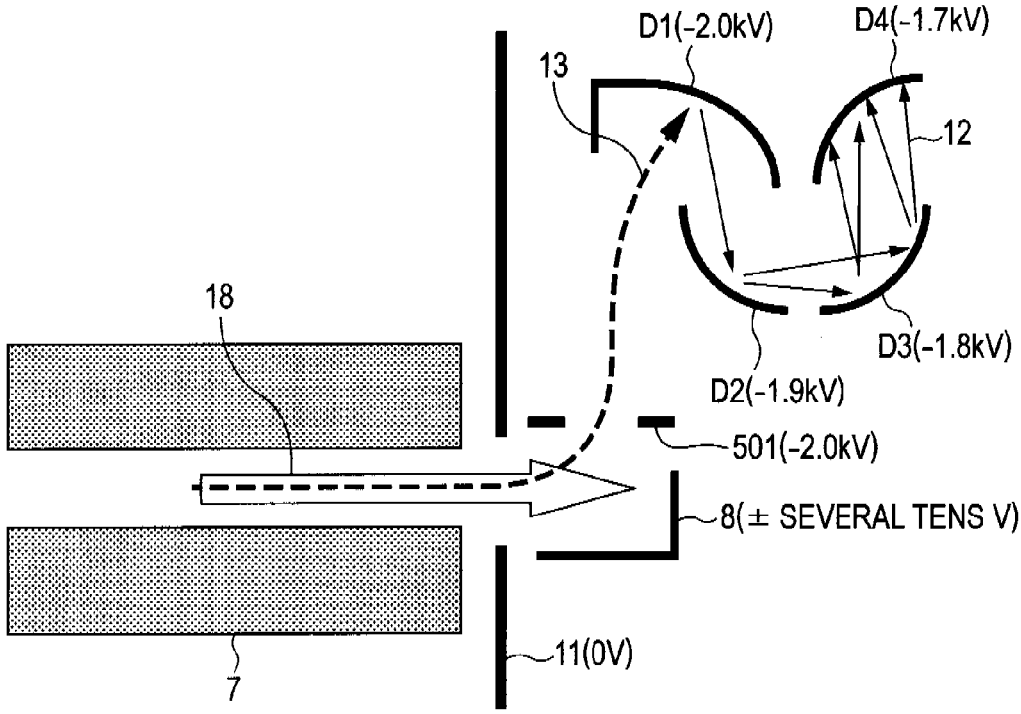
FIG. 5A is a drawing showing a part of a mass spectrometer according to an embodiment of the invention, and is a schematic view for explaining an ion analyzer.
Figure 5B:
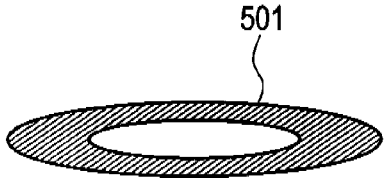
FIG. 5B is a perspective view of the lead-in electrode of the ion analyzer shown in FIG. 5A.

FIG. 5 is a drawing showing a part of the mass spectrometer according to the embodiment, and a schematic view for explaining an ion analyzer. FIG. 5B is a perspective view of the lead-in electrode of the ion analyzer shown in FIG. 5A. The embodiment differs from the fourth embodiment only in that 1) the "lead-in electrode" has a ring shape and 2) the deflection board is made shorter, and the others are identical. The area of the "lead-in electrode" is set to be around 1/3 of that in the examination example.

In FIG. 5A, the deflection board 8 is provided at the previous stage in the traveling direction of the ion 13 introduced from the mass aperture board 11 as the ion introduction part, and, at the rear stage, a ring-shaped lead-in electrode 501 such as a flat board with a hole is provided. The ion 13 introduced into the ion detection unit 4 passes through the opening part of the ring-shaped lead-in electrode 501. To the lead-in electrode 501, a potential of −2.0 kV is applied. Moreover, the area of the lead-in electrode 501 is set to be an area resulting in the incident amount of the internal stray light to the electrode D1 not more than the incident amount of the external stray light to the electrode D1, in an arbitrary introduction of ions.

As compared with the fourth embodiment, in the embodiment, since the area of the "lead-in electrode" is larger slightly, the generation amount of high-energy electrons is also larger slightly, but, when compared with the examination example, the noise is reduced to 1/3. On the other hand, since the lead-in electrode 501 has a ring-like shape, it is axially symmetric in the electrode D1 direction. Accordingly, even in a part of transporting the ion 13 to the electrode D1 (a part where "lead-in electrode" does not exist in the fourth embodiment), disturbance of the ion beam is a little to make it possible to make the final ion detection efficiency higher than that in the fourth embodiment.

Sixth Embodiment

Figure 6A:
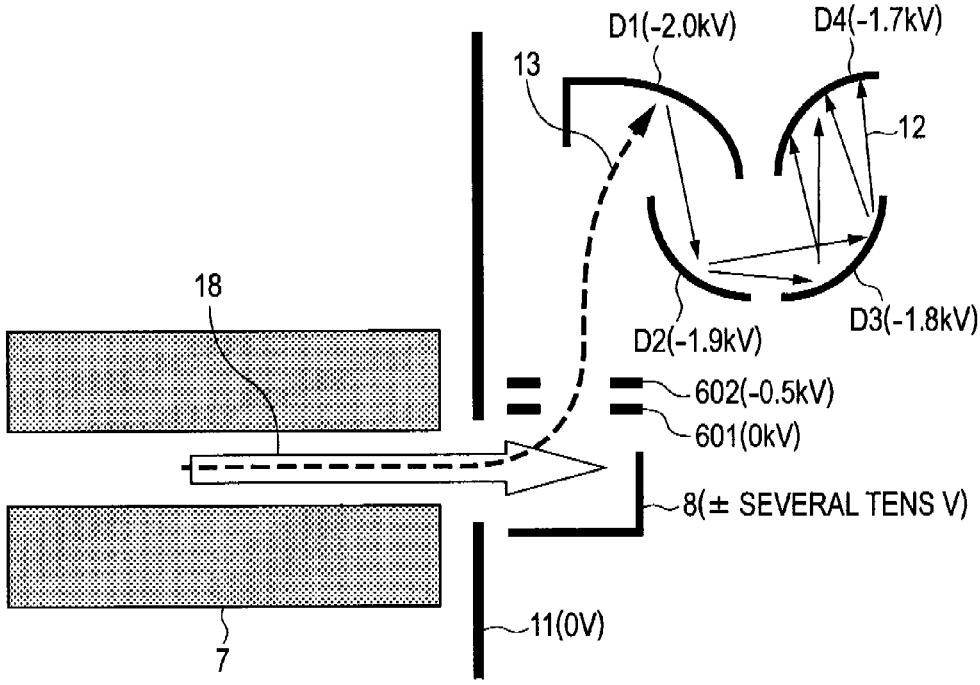
FIG. 6A is a drawing showing a part of a mass spectrometer according to an embodiment of the invention, and is a schematic view for explaining an ion analyzer.
Figure 6B:
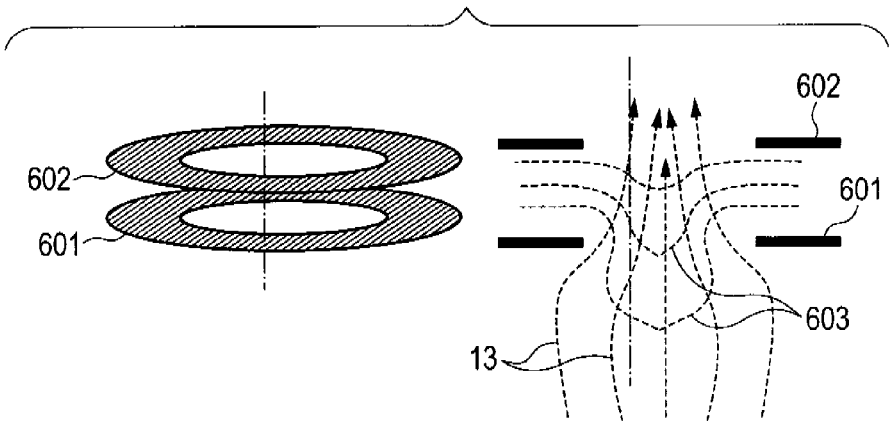
FIG. 6B is a drawing for explaining the lead-in electrode of the ion analyzer shown in FIG. 6A.

FIG. 6A is a drawing showing a part of the mass spectrometer according to the embodiment, and a schematic view for explaining an ion analyzer. FIG. 6B is a drawing for explaining the lead-in electrode of the ion analyzer shown in FIG. 6A. The embodiment differs from the fifth embodiment only in that 1) the ring-shaped "lead-in electrode" is doubled and 2) among the doubled ring-shaped lead-in electrodes, the applied voltage on the electrode D1 side is −0.5 kV and the applied voltage on the deflection board side is 0 V, and the others are identical.

In FIG. 6A, at the previous stage in the traveling direction of the ion 13 introduced from the mass aperture board 11 as an ion introduction part, the deflection board 8 is provided, and, at the rear stage, a ring-shaped lead-in electrode 601 and a ring-shaped lead-in electrode 602 are provided. The ion 13 introduced into the ion detection unit 4 passes through opening parts of the ring-shaped lead-in electrodes 601 and 602. To the lead-in electrode 601, a potential of 0 kV is applied, and, to the lead-in electrode 602, a potential of −0.5 kV is applied. Moreover, areas of the lead-in electrodes 601 and 602 are set to be an area giving the incident amount of the internal stray light to the electrode D1 equal to or less than the incident amount of the external stray light to the electrode D1, in an arbitrary introduction of ions.

As compared with the fifth embodiment, in the embodiment, an "effective" area of the "lead-in electrode" is a half. On the other hand, the "effective" area of the "lead-in electrode" is 1/6 relative to that in the examination example, and the generation amount of high-energy electrons and the noise are also 1/6. The following explains "effective." In the embodiment, two "lead-in electrodes" are set to give an actual surface area doubled, but, to both faces sandwiched between two lead-in electrodes 601 and 602, a slight stray light is irradiated. Accordingly, since only a very few high-energy electrons generated from there reach the electrode D1, the areas of both sides are negligible. Furthermore, since the applied potential to the lead-in electrode 601 being one electrode is set to be 0 V, from the viewpoint of the noise, the areas thereof are also negligible. Moreover, the applied potential to the lead-in electrode 602 being an electrode to which a voltage is applied is also set to be 1/4 as compared with that in the examination example of the invention, the noise is reduced by one digit, from the relation that the noise is proportional to 1.6 power of the energy. Accordingly, from the contribution of both area/voltage, the noise by the internal stray light can be reduced to 1/60, as compared with the examination example.

On the other hand, as shown in FIG. 6B, since an electric field 603 on the underside (mass aperture board 11 side) of electric fields generated by lead-in electrodes 601 and 602 has such shape that strongly converges ions (an immersion type lens) using cleverly a leaching electric field, although the applied voltage is low, the detection efficiency for original ions to be detected, that is, a signal is improved. That is, as in the embodiment, by providing two ring-shaped lead-in electrodes, ions can be converged efficiently. And, by setting the potential so that ions are accelerated from the lead-in electrode 601 on the deflection board 8 side to the lead-in electrode 602 on the electrode D1 side, the leaching electric field can cleverly be used as described above, and the ion conversion can more effectively be performed.

The applied voltages to the lead-in electrodes 601 and 602 are set to be −0.5 kV and 0 V respectively, but are not limited to these, and the optimum value that makes S/N maximum can freely be selected. Moreover, the diversion of a resistance-divided voltage in the SEM 9 is more desirable.

Seventh Embodiment

Figure 7A:
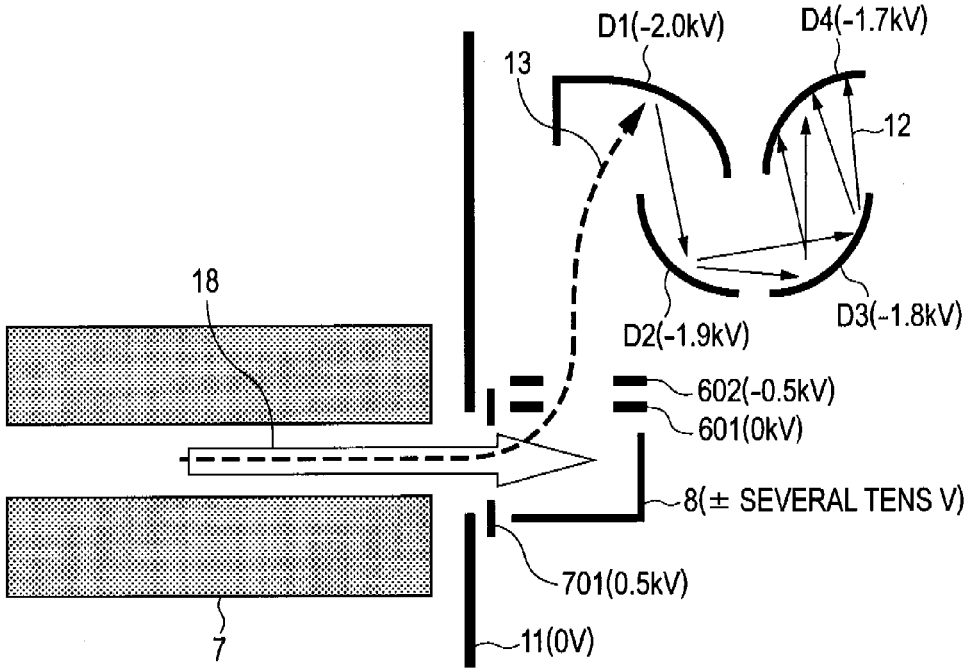
FIG. 7A is a drawing showing a part of a mass spectrometer according to an embodiment of the invention, and is a schematic view for explaining an ion analyzer.
Figure 7B:
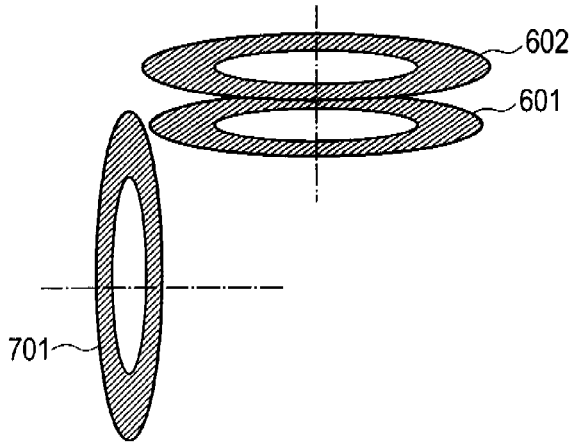
FIG. 7B is a perspective view of the lead-in electrode and the convergence electrode of the ion analyzer shown in FIG. 7A.

FIG. 7A is a drawing showing a part of the mass spectrometer according to the embodiment, and a schematic view for explaining an ion analyzer. FIG. 7B is a perspective view showing the lead-in electrodes and the convergence electrode of the ion analyzer shown in FIG. 7A. The embodiment differs from the sixth embodiment only in that another "lead-in electrode" is provided directly behind the mass aperture board 11 and, to the other lead-in electrode, a potential of −0.5 kV is applied, and the others are identical.

In the embodiment, as shown in FIG. 7, in the form shown in FIG. 6, a ring-shaped lead-in electrode (a convergence electrode) 701 is provided between the mass aperture board 11 as an ion introduction part and the deflection board 8. The ion 13 introduced from the aperture of the mass aperture board 11 passes through the opening part of the lead-in electrode 701 as the convergence electrode. To the lead-in electrode 701, a potential of −0.5 kV is applied.

In the embodiment, as compared with the sixth embodiment, the area of the "lead-in electrode" increases and the noise also increases, but ions leaving the mass aperture board 11 are converged by the new lead-in electrode 701, and are further converged by the effect of a leaching electric field occurring between the aperture and the lead-in electrode 701, which was explained above, and, therefore, the detection efficiency for the original ion to be detected is further improved. But, since the area of the lead-in electrode is doubled as compared with the sixth embodiment, the reduction of the noise is 1/30 as compared with the examination example of the invention.

The applied voltages to the lead-in electrodes 701 is set to be −0.5 kV, but are not limited to this, and the optimum value that makes S/N maximum can freely be selected. Moreover, the diversion of a resistance-divided voltage in the SEM 9 is more desirable.

Eighth Embodiment

Figure 8:
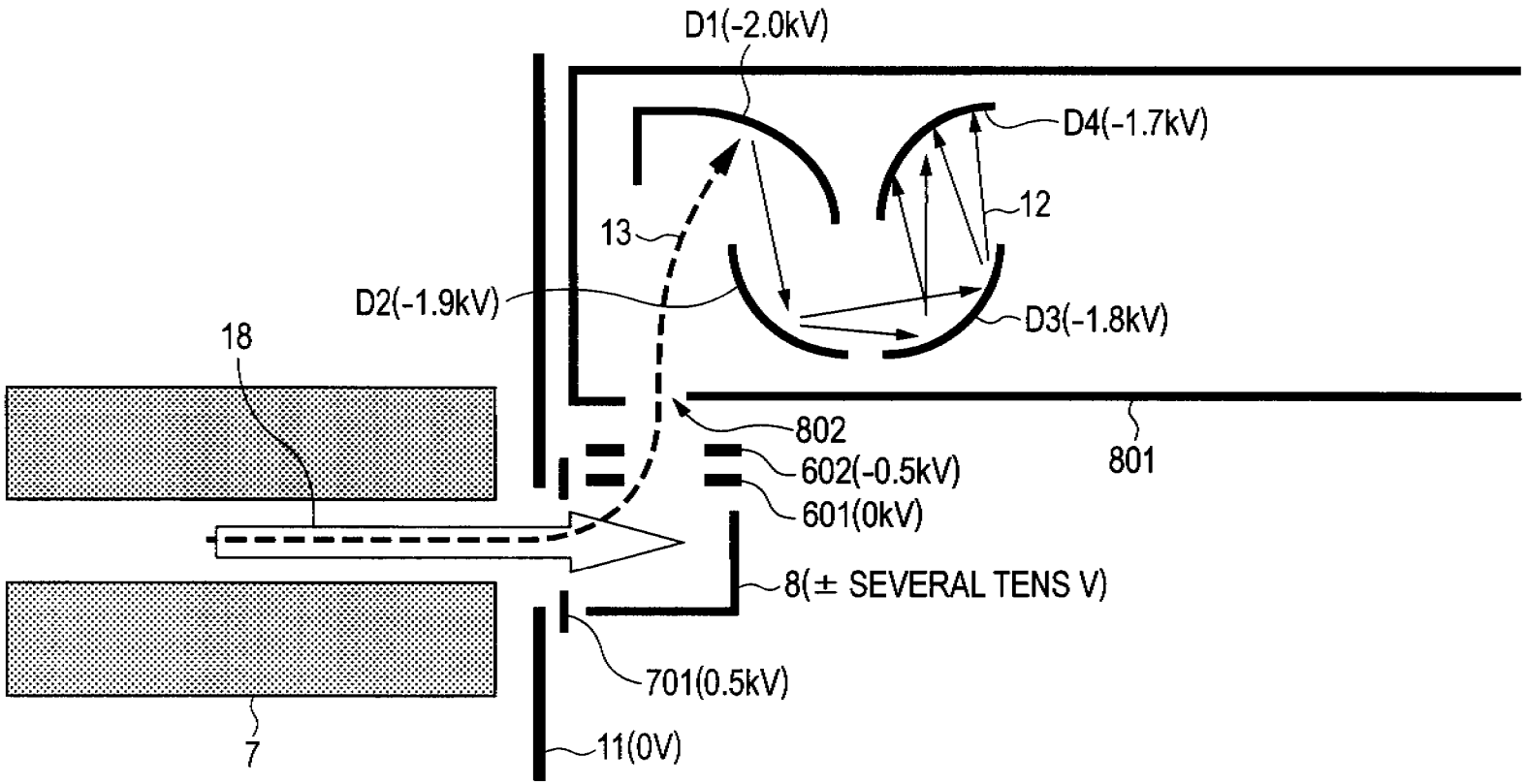
FIG. 8 is a drawing showing a part of a mass spectrometer according to an embodiment of the invention, and is a schematic view for explaining an ion analyzer.

FIG. 8 is a drawing showing a part of the mass spectrometer according to the embodiment, and is a schematic view for explaining an ion analyzer. The embodiment differs from the seventh embodiment only in that the SEM 9 is covered with a shielding case, and the others are identical.

In the embodiment, as shown in FIG. 8, in the form shown in FIG. 7, the secondary electron multiplier (SEM) 9 is surrounded by a shielding case 801. For the shielding case 801, an entrance 802 for taking in an ion as an ion introduction part is provided. The entrance 802 for taking in an ion is positioned so that the ion 13 pulled in by the lead-in electrodes 601 and 602 enters suitably the electrode D1.

Excluding the entrance 802 for taking in an ion, the shielding case 801 is sealed as far as possible, and prevents high-energy electrons generated from lead-in electrodes 601 and 602 from entering directly electrodes D2, D3 etc. to act as a noise. Accordingly, although the aforementioned reduction based on the effect of the area/voltage of the "lead-in electrode" is the same as that based on the seventh embodiment, a noise based on another cause can be reduced.

Ninth Embodiment

In the invention, since complex structures are handled and phenomena are also sensitive/various such as conversion, reflection, irradiation and flying of various particles, in the embodiment, an example of quantifying the invention according to one standard of the invention is shown, in order to show the common concept thereof.

Figure 15A:
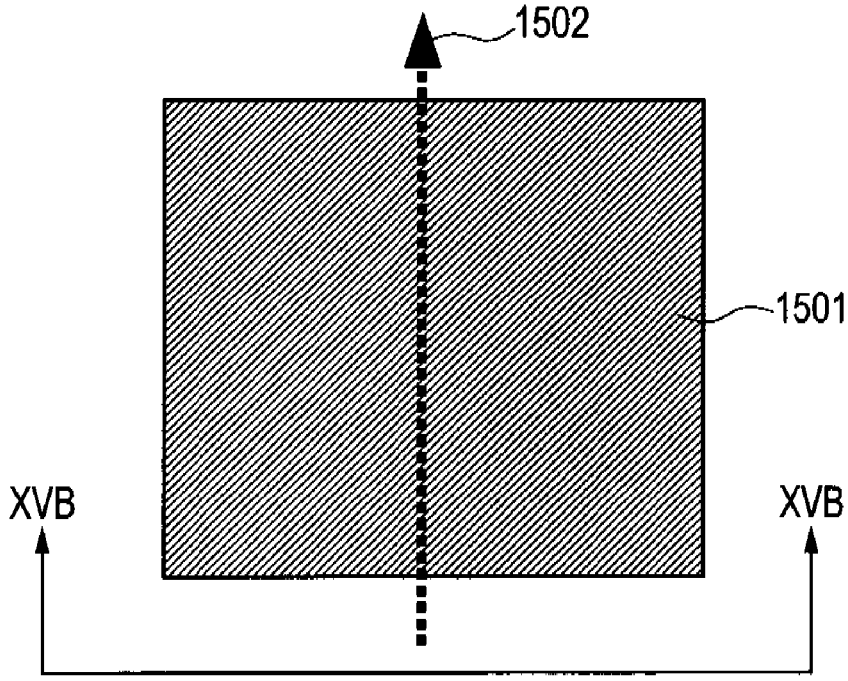
FIG. 15A is a drawing for explaining an example of the quantification of the invention according to an embodiment of the invention, and is an explanatory view for an area.
Figure 15B:
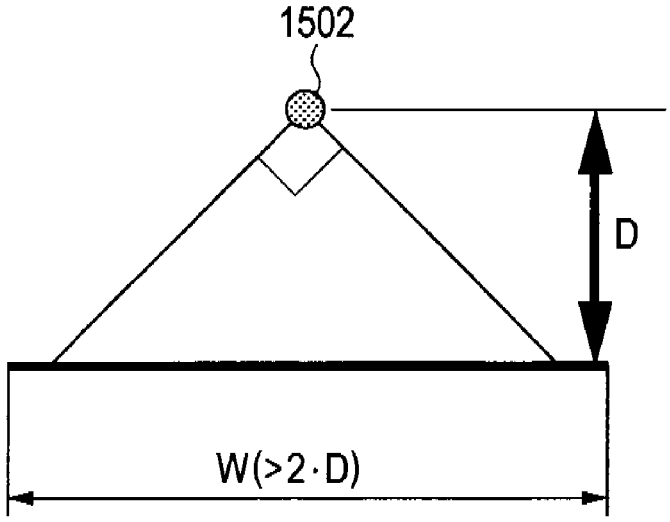
FIG. 15B is a cutaway view along the XVB-XVB line in FIG. 15A.
Figure 16:
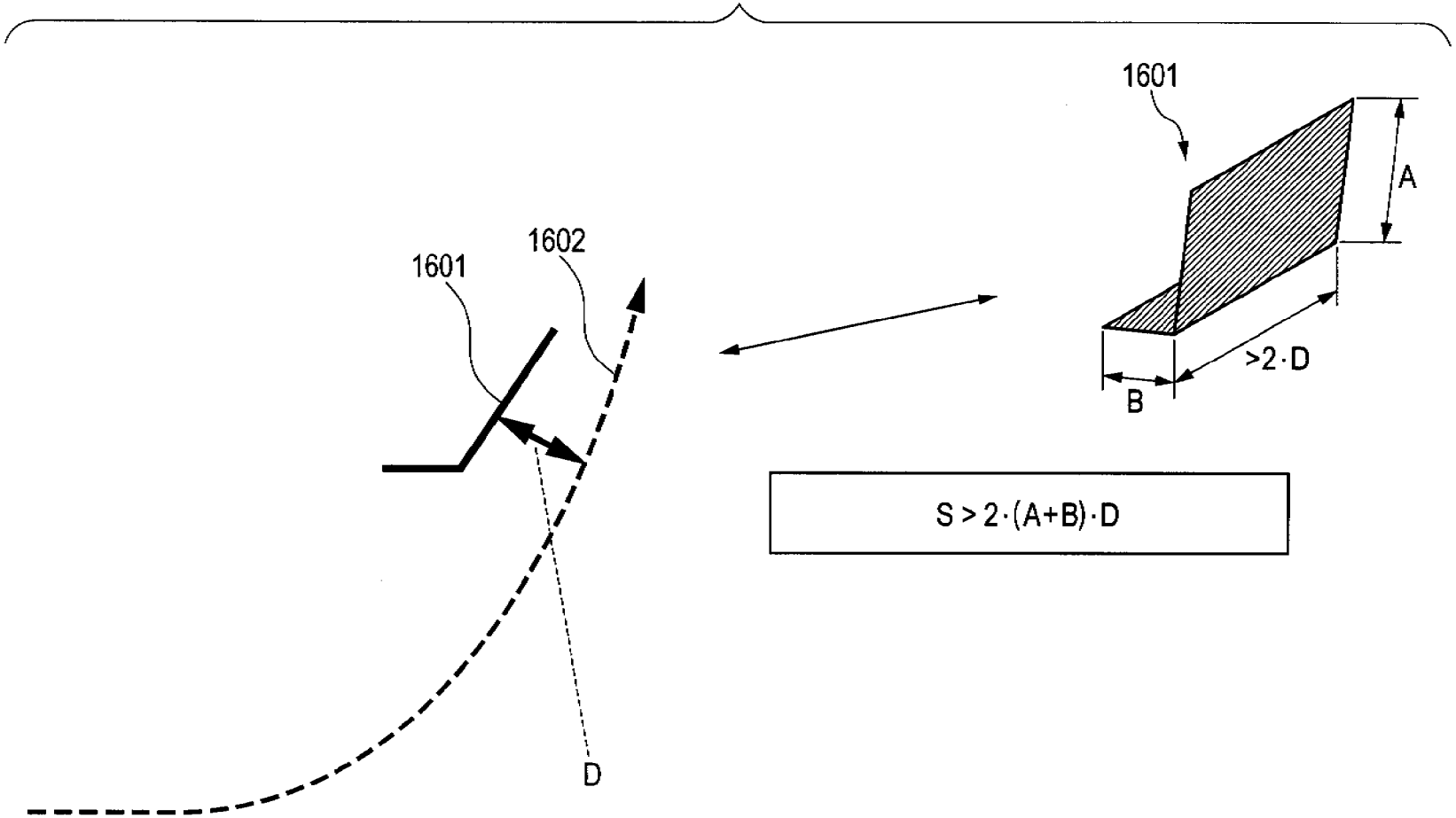
FIG. 16 is a drawing for explaining an example of the quantification of the invention according to an embodiment of the invention, and is an explanatory view for an area.
Figure 17:
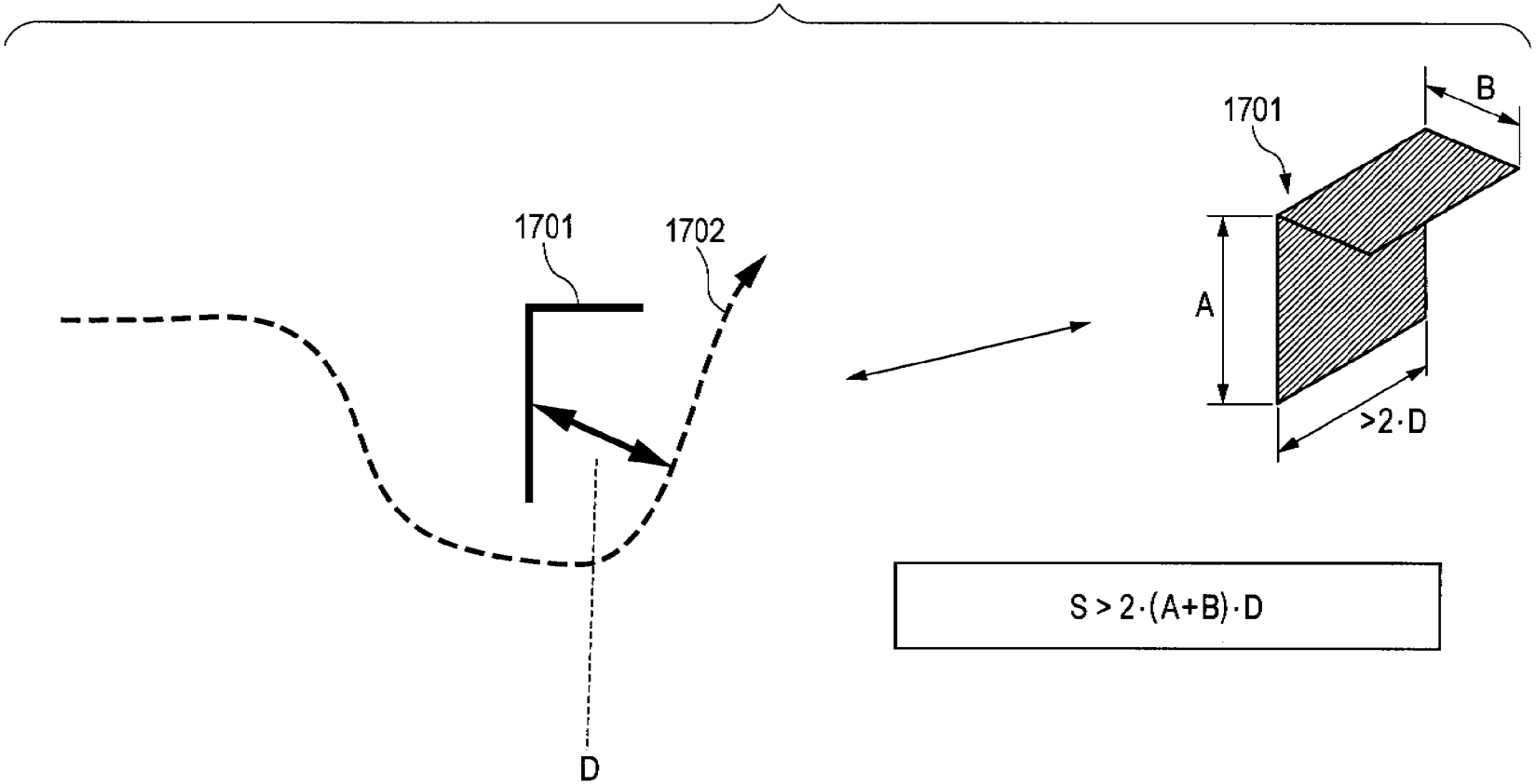
FIG. 17 is a drawing for explaining an example of the quantification of the invention according to an embodiment of the invention, and is an explanatory view for an area.
Figure 18:
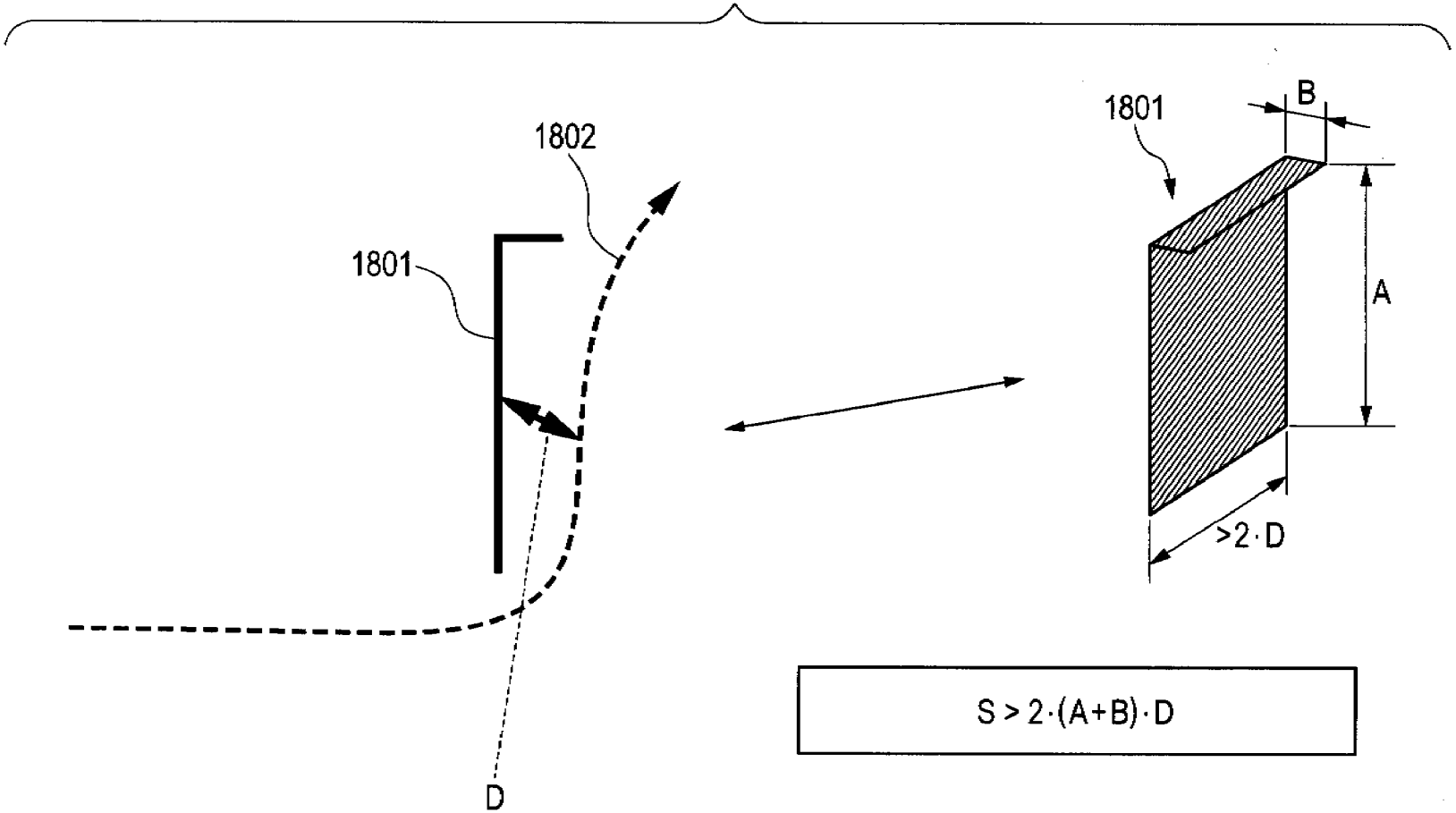
FIG. 18 is a drawing for explaining an example of the quantification of the invention according to an embodiment of the invention, and is an explanatory view for an area.

At the beginning, assumption/definition of various conditions are performed, but, since the effects needed are rough, such as a half/one digit, they shall be determined schematically from the essential viewpoint, without worrying about details. First, since the rear face and the side face of the "lead-in electrode" are set to be the ground potential, in FIGS. 1 to 8, when the length of the lead-in electrode in the direction perpendicular to the paper (the length of the lead-in electrode in the direction perpendicular to the flying direction of ions) is too short, the electric field on the ion trajectory is disturbed to affect the arrival of the ion at the electrode D1. As shown in FIG. 15A, in order not to disturb the electric field, a length W of a lead-in electrode 1501 in the direction perpendicular to the traveling direction of an ion 1502 (the above-described length in the direction perpendicular to the paper) is required to be equal to or more than two times the distance from the ion 1502. That is, as shown in FIG. 15B, when denoting the distance between the lead-in electrode 1501 and the ion 1502 by D, the length W of the lead-in electrode 1501 is equal to or more than 2×D. Consequently, for example, as shown in FIGS. 16 to 18, when denoting the length of lead-in electrodes 1601, 1701 and 1801 in the passing direction of ions (reference numerals 1602, 1702 and 1802) by A+B, the areas S of lead-in electrodes 1601, 1701 and 1801 are equal to or more than 2×(A+B)×D.

Next, in the embodiment, as a standard, the area in which high-energy electrons actually contributable to the incidence to the electrode D1 (noise generation) in the "area of the lead-in electrode" (also called a "high-energy electron generation area S'") shall be the area that is a part of the lead-in electrode and is seen from an ion trajectory going from the mass aperture board toward the SEM. But, faces which almost no stray light/stray ion can reach or faces from which almost no high-energy electrons generated are scattered toward the outside (rear faces of wall/electrode facing each other at close range, etc.) are excluded from the high-energy electron generation area S'. High-energy electron generation areas for extraction electrodes of various shapes are shown in FIGS. 19A to 19C, and FIGS. 20A and 20B.

Figure 19A:
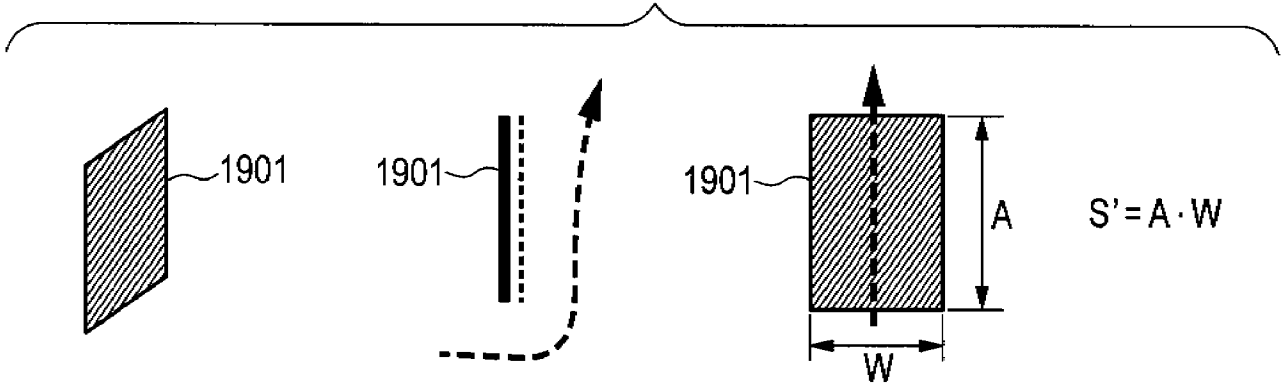
FIG. 19A is a drawing for explaining a high-energy electron generation area according to an embodiment of the invention.
Figure 19B:
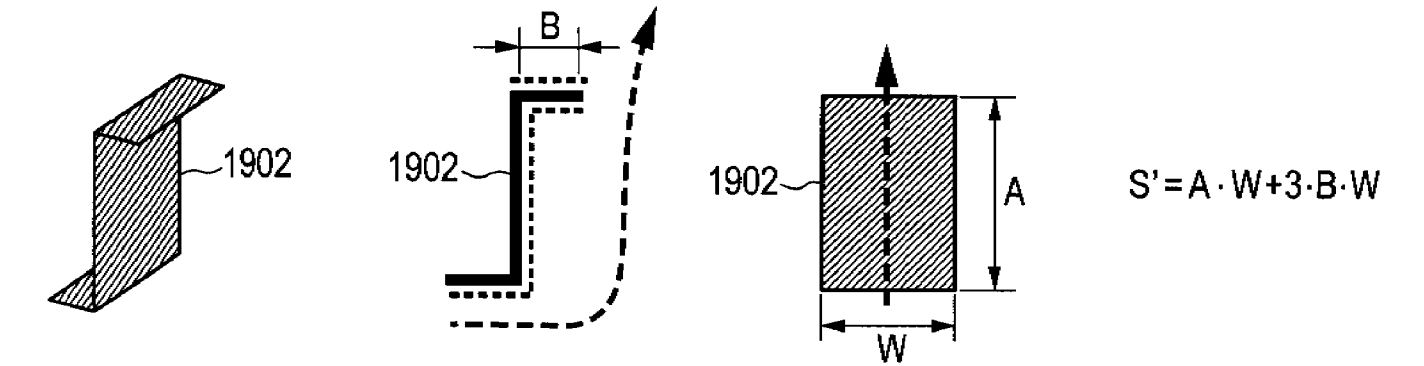
FIG. 19B is a drawing for explaining a high-energy electron generation area according to an embodiment of the invention.
Figure 19C:
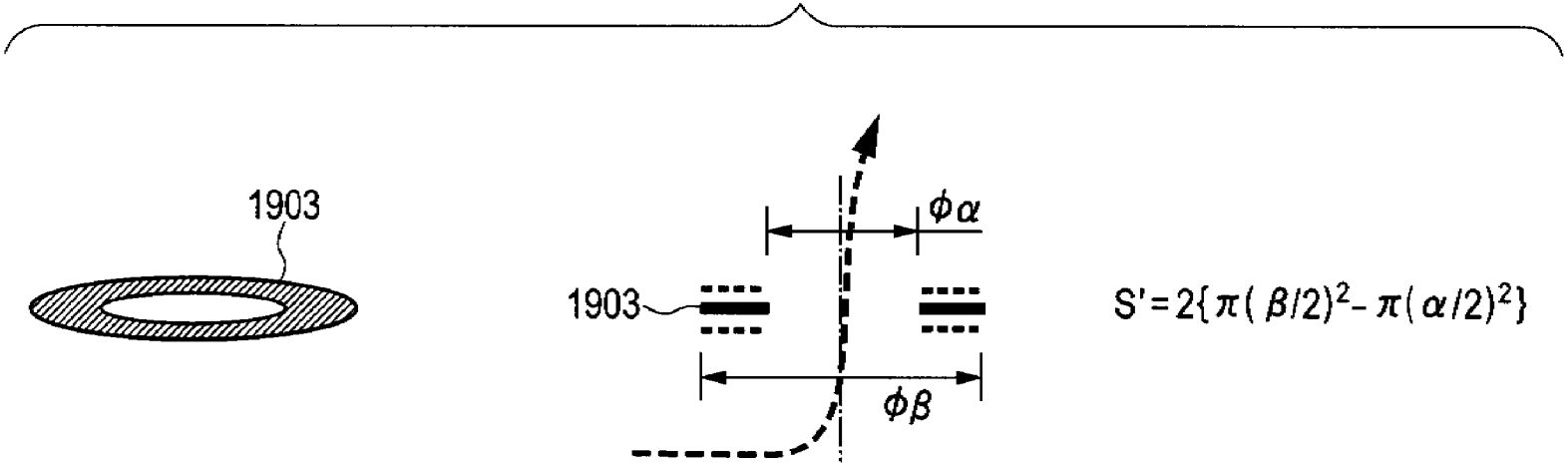
FIG. 19C is a drawing for explaining a high-energy electron generation area according to an embodiment of the invention.

In FIG. 19A, a reference numeral 1901 denotes a board-shaped lead-in electrode. Accordingly, the high-energy electron generation area $S'=A\times W$. And, in FIG. 19B, a reference numeral 1902 denotes a lead-in electrode of a shape formed by bending a board-shaped electrode in two places. Accordingly, the high-energy electron generation area $S'=A\times W+3\times BW$. Furthermore, in FIG. 19C, a reference numeral 1903 is a ring-shaped lead-in electrode. Accordingly, the high-energy electron generation area $S'=2\{\pi(\beta/2)^2-\pi(\alpha/2)^2\}$.

Figure 20A:
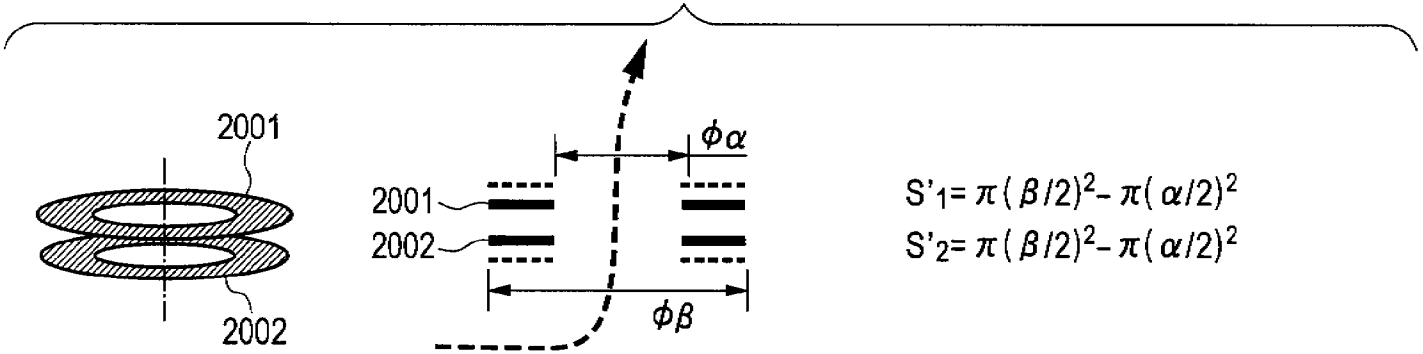
FIG. 20A is a drawing for explaining a high-energy electron generation area according to an embodiment of the invention.

Moreover, in FIG. 20A, reference numerals 2001 to 2002 denote ring-shaped lead-in electrodes. Accordingly, for the ring-shaped lead-in electrode 2001, the high-energy electron generation area $S_1'=\pi(\beta/2)^2-\pi(\alpha/2)^2$, and, for the ring-shaped lead-in electrode 2002, the high-energy electron generation area $S_2'=\pi(\beta/2)^2-\pi(\alpha/2)^2$.

Figure 20B:
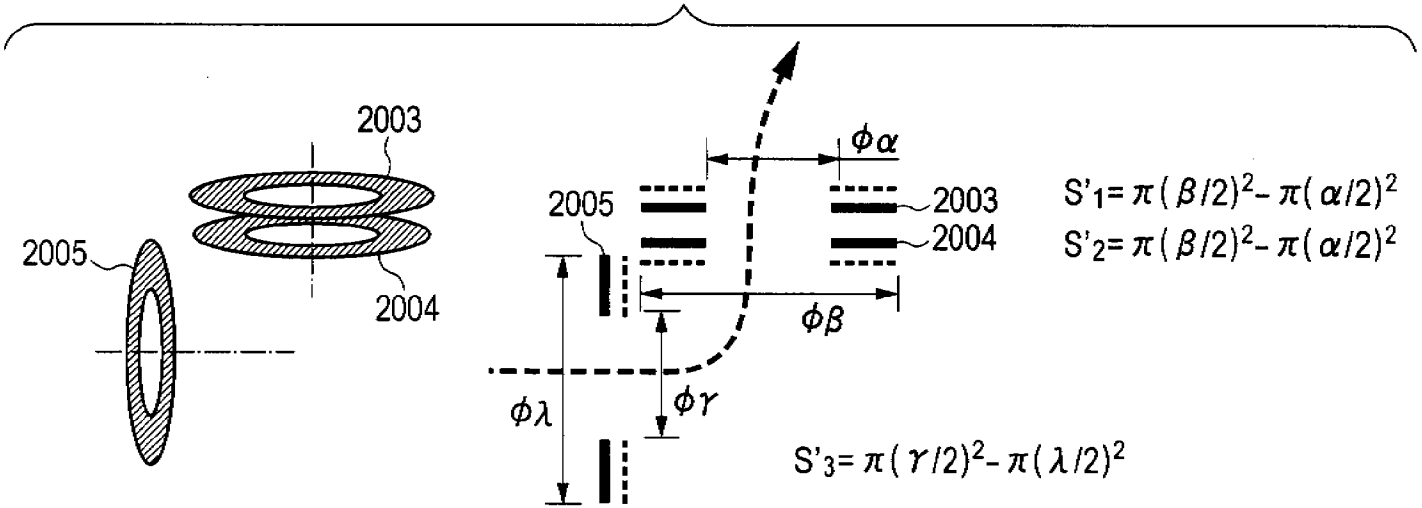
FIG. 20B is a drawing for explaining a high-energy electron generation area according to an embodiment of the invention.

Furthermore, in FIG. 20B, reference numerals 2003 to 2005 denote ring-shaped lead-in electrodes. Accordingly, for the ring-shaped lead-in electrode 2003, the high-energy electron generation area $S_1'=\pi(\beta/2)^2-\pi(\alpha/2)^2$, for the ring-shaped lead-in electrode 2004, the high-energy electron generation area $S_2'=\pi(\beta/2)^2-\pi(\alpha/2)^2$, and for the ring-shaped lead-in electrode 2005, the high-energy electron generation area $S_3'=\pi(\gamma/2)^2-\pi(\lambda/2)^2$.

Furthermore, in the embodiment, as one standard, the "ion traveling path" shall be "a distance from a potential face of 80% of a lead-in electrode to the entrance face of an SEM". This is based on that "a potential face of 80% of the "lead-in electrode" may be necessary from the viewpoint of the pull-in effect of ions, and that effective trajectory is formed in the SEM at the "SEM entrance face" and in subsequent portions. Such ion traveling paths are shown in FIGS. 21A to 23.

Figure 21A:
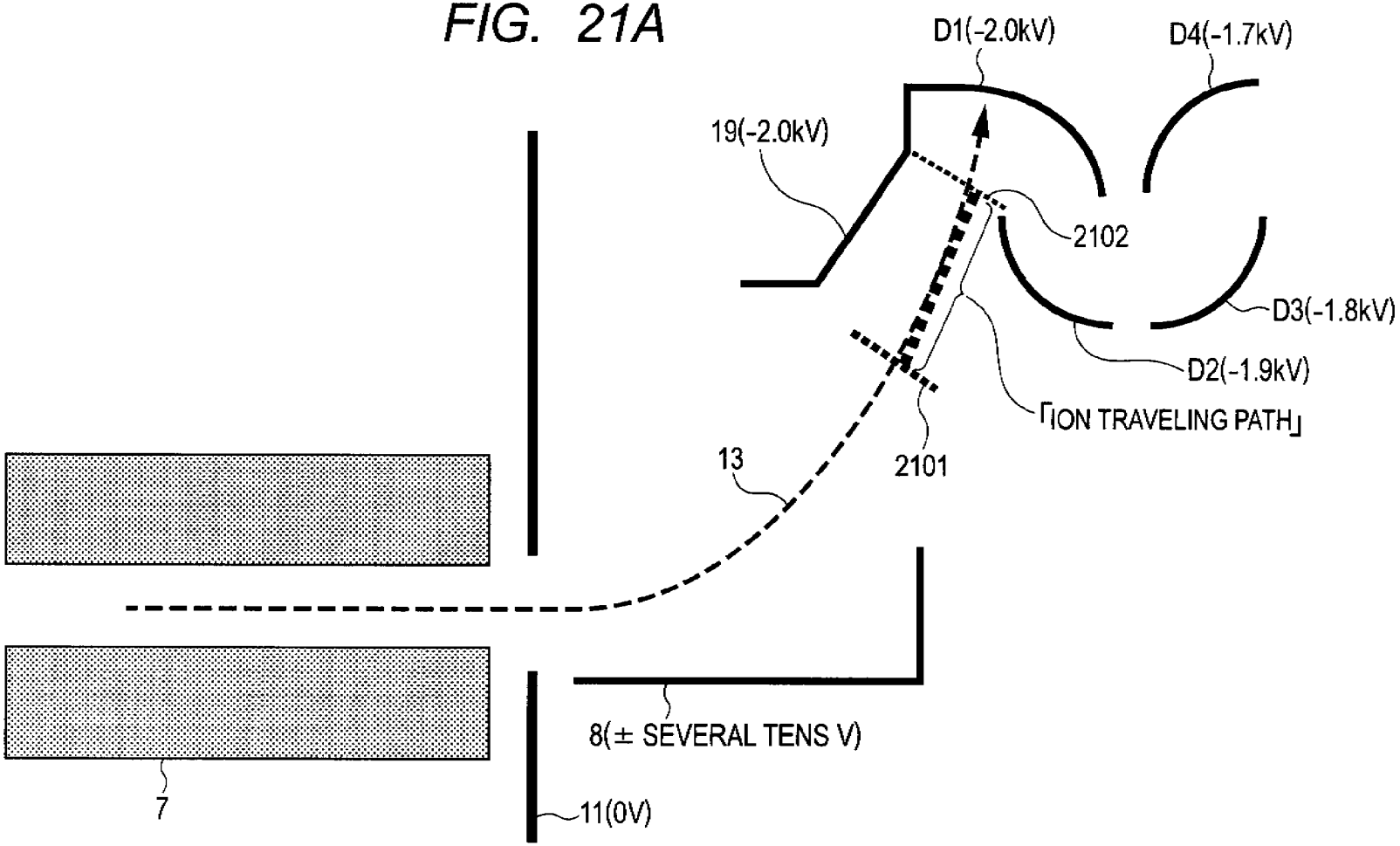
FIG. 21A is a drawing for explaining an ion traveling path according to an embodiment of the invention.
Figure 21B:
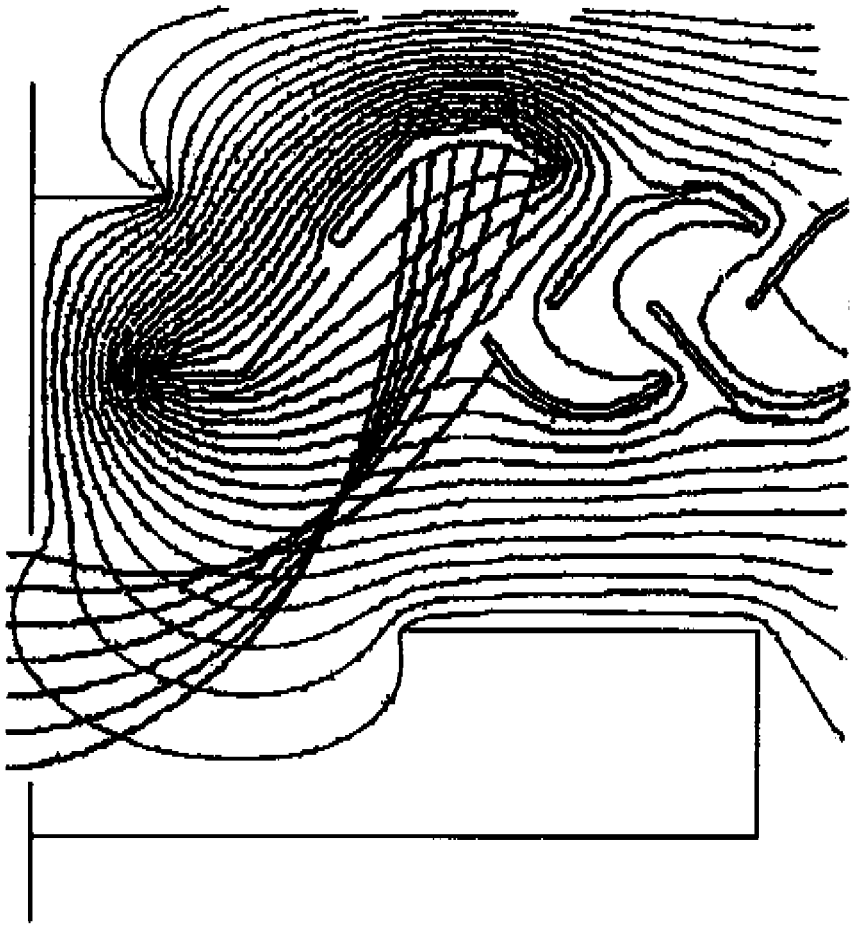
FIG. 21B is a drawing showing a simulation result performed for determining a potential surface of 80% of the lead-in electrode in FIG. 21A.
Figure 22:
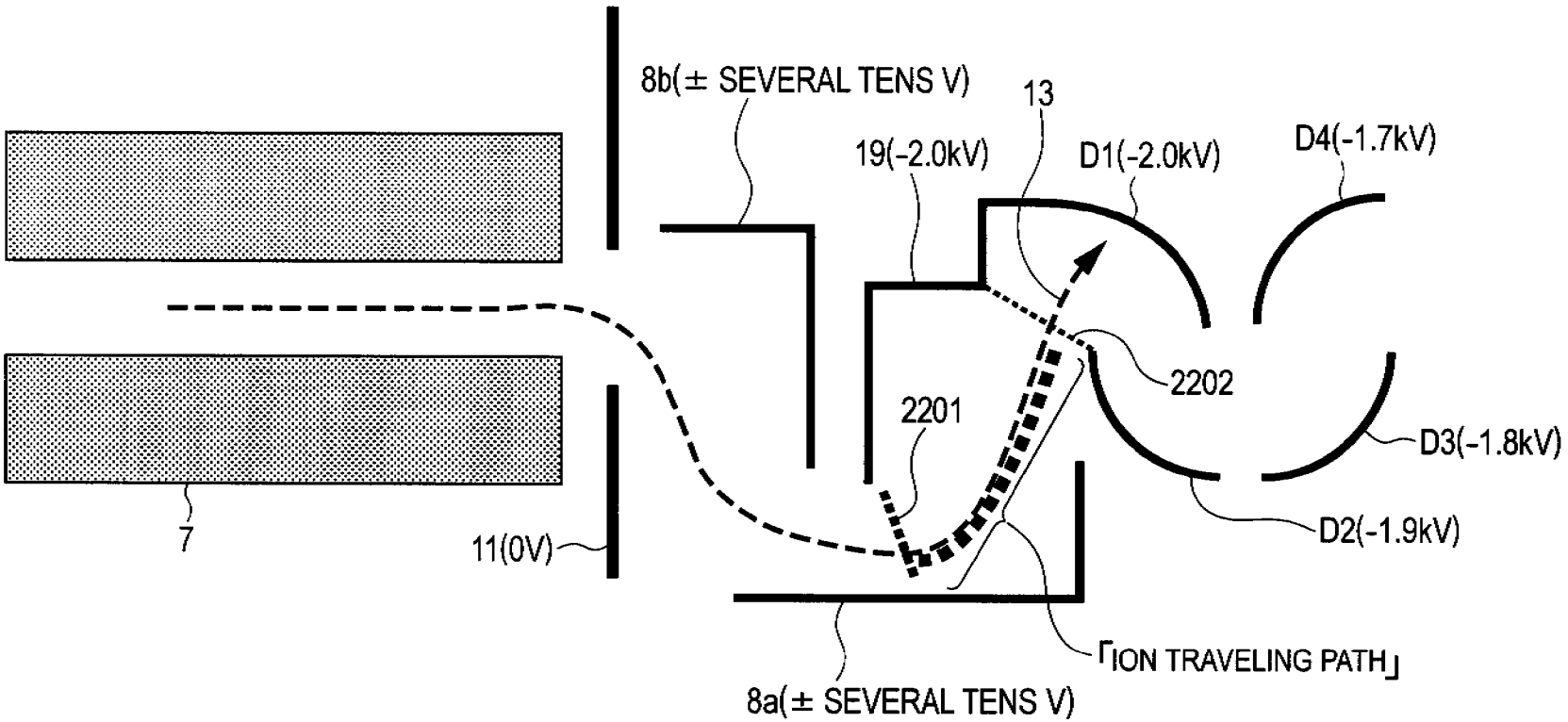
FIG. 22 is a drawing for explaining an ion traveling path according to an embodiment of the invention.
Figure 23:
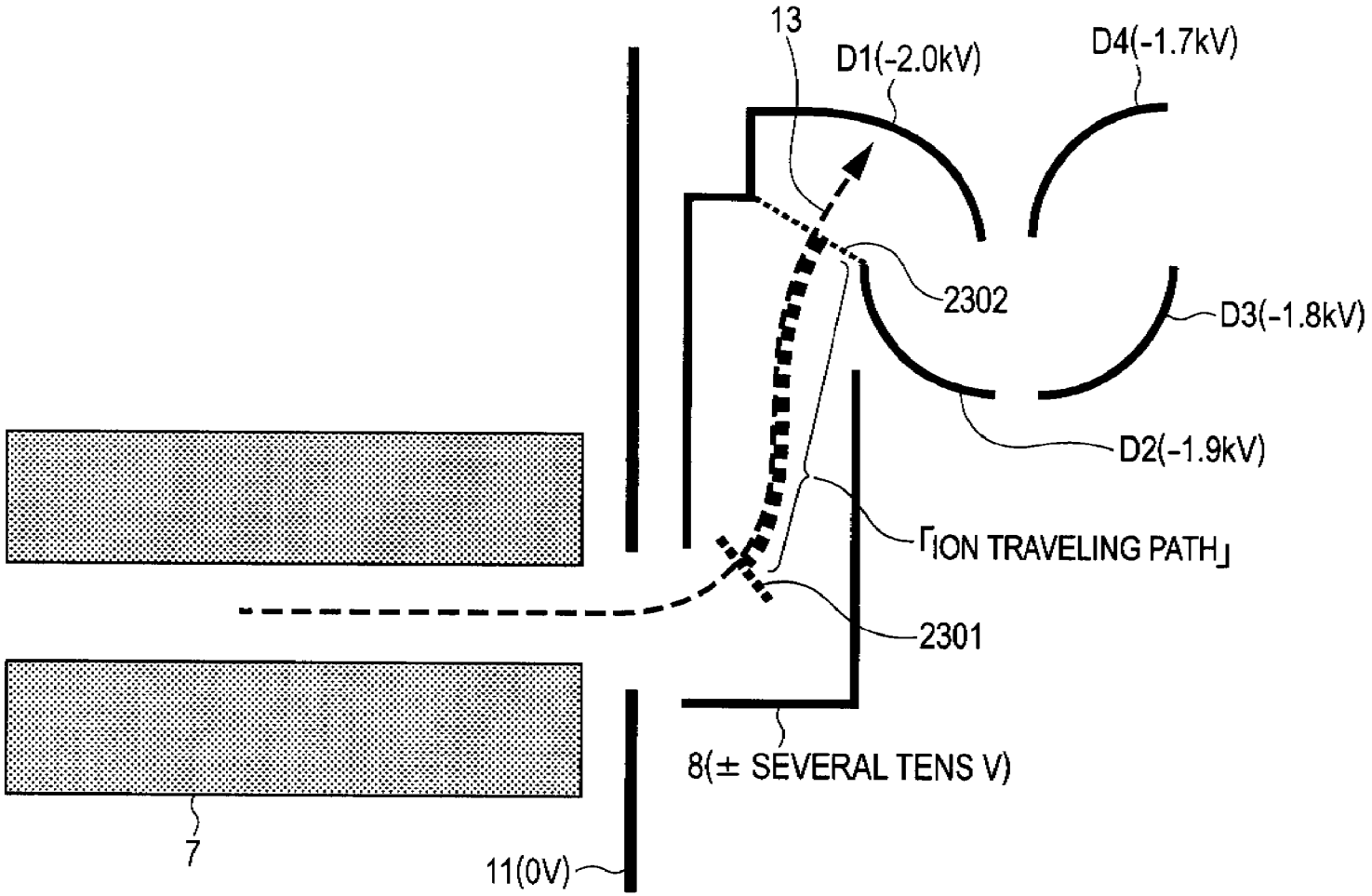
FIG. 23 is a drawing for explaining an ion traveling path according to an embodiment of the invention.

As examples, each of the ion traveling paths in the second conventional example shown in FIG. 11, the third conventional example shown in FIG. 12 and the examination example of the invention shown in FIG. 13 is shown in FIGS. 21A, 22 and 23. In FIGS. 21A, 22 and 23, the 80% potential faces of the lead-in electrode are denoted by reference numerals 2101, 2201 and 2301, and SEM entrance faces are denoted by reference numerals 2102, 2202 and 2302. Meanwhile, the 80% potential face of the lead-in electrode can be determined from the performance of a potential face analysis simulation and the simulation analysis result as shown in FIG. 21B.

Using standard examples assumed/defined above, the invention is generalized. In each of the first, fourth, fifth, sixth and seventh embodiments, the area of the "lead-in electrode" (accurately, the high-energy electron generation area) is made smaller than that in the second and third conventional examples and the examination example of the invention. This is because the inventor newly found that the noise is proportional to the area of the "lead-in electrode," but, conventionally, this is not estimated and "lead-in electrode" is designed from another viewpoint such as an ion trajectory. Consequently, in the examination example of the invention, when estimating that the influence of the internal stray light is three times the influence of the external stray light, such quantitative generalization is possible that "in order to make the influence of the internal stray light on the S/N ratio smaller than the influence of the external stray light on the S/N ratio, when denoting an ion traveling path by L, a distance between the ion and the lead-in electrode by D, and the high-energy electron generation area by S, they should be: $S<1/3\times(2\times L\times D)$." This is only an example of the quantification, but, when estimating that the effect of the internal stray light is three times the effect of the external stray light in the examination example in FIG. 13, the relational formula obtained by the quantification can be used as one guideline for the designing.

In addition, in each of the second, third, sixth and seventh embodiments, the potential difference between the "lead-in electrode" and electrodes lying near it (for example, the deflection board) is set smaller than that in conventional examples or the examination example of the invention. This is based on that the inventor of this application newly found that the noise was proportional to a square of the voltage of the "lead-in electrode", but conventionally it is not estimated, and the applied voltage to the lead-in electrode is set to be identical to the potential of the first-stage electrode (D1) of the secondary electron multiplier with the highest pull-in efficiency and easy voltage application. Consequently, likewise from the examination example of the invention, it is possible to generalize quantitatively that "in order to make the influence of the internal stray light on the S/N ratio smaller than the influence of the external stray light on the S/N ratio, when denoting the potential of the first-stage electrode of a secondary electron multiplier by $V_{D1}$, the potential of the "lead-in electrode" by $V_E$ and the potential of an electrode lying near the "lead-in electrode" by $V_S$, they should be: $|V_{D1}-V_S|_{absolute\ value}<1/2|V_E|_{absolute\ value}$". This is also only an example of the quantification.

Using the above formulae, the outline of respective amounts in conventional examples, the examination example and respective embodiments are shown quantitatively.

TABLE 1

| | FORMULA OF HIGH-ENERGY ELECTRON GENERATION AREA AND RATIO TO EXAMINATION EXAMPLE | POTENTIAL DIFFERENCE BETWEEN D1 AND NEIGHBORING ELECTRODE | REDUCTION EFFECT OF INTERNAL STRAY LIGHT NOISE | RATIO OF INTERNAL LIGHT NOISE TO EXTERNAL LIGHT |
|---|---|---|---|---|
| FIRST CONVENTIONAL EXAMPLE | NONE | NONE | NONE | — |
| SECOND CONVENTIONAL EXAMPLE | 2(A + B)D ~2LD | $V_E$ | NONE | — |
| THIRD CONVENTIONAL EXAMPLE | SAME AS ABOVE | SAME AS ABOVE | NONE | — |

TABLE 1-continued

| | FORMULA OF HIGH-ENERGY ELECTRON GENERATION AREA AND RATIO TO EXAMINATION EXAMPLE | POTENTIAL DIFFERENCE BETWEEN D1 AND NEIGHBORING ELECTRODE | REDUCTION EFFECT OF INTERNAL STRAY LIGHT NOISE | RATIO OF INTERNAL LIGHT NOISE TO EXTERNAL LIGHT |
|---|---|---|---|---|
| EXAMINATION EXAMPLE | SAME AS ABOVE | SAME AS ABOVE | NONE | THREE TIMES |
| FIRST EMBODIMENT | 1/10 · (2(A + B)D) ~1/10 · 2LD 1/10 | SAME AS ABOVE | 1/10 | 3/10 |
| SECOND EMBODIMENT | 2(A + B)D ~2LD 1/1 | 1/4 $V_E$ | 1/10 | 3/10 |
| THIRD EMBODIMENT | SAME AS ABOVE | SAME AS ABOVE | 1/10 | 3/10 |
| FOURTH EMBODIMENT | 2(A + B)D ~1/4 · 2LD 1/4 | $V_E$ | 1/4 | 3/4 |
| FIFTH EMBODIMENT | 2{π(β/2)2 − π(α/2)2} ~1/3 · 2LD 1/3 | SAME AS ABOVE | 1/3 | EQUIVALENT |
| SIXTH EMBODIMENT | π(β/2)2 − π(α/2)2 ~1/6 · 2LD 1/6 | 1/4 $V_E$ | 1/60 | 1/20 |
| SEVENTH EMBODIMENT | π(β/2)2 − π(α/2)2 + π(γ/2)2 − π(λ/2)2 ~1/3 · 2LD 1/3 | SAME AS ABOVE | 1/30 | 1/10 |
| EIGHTH EMBODIMENT | SAME AS ABOVE | SAME AS ABOVE | 1/30-α | 1/10-α |

Meanwhile, in Table 1, numerical values described with an underline show the ratio relative to the examination example. The symbol "~" shows approximately identical. The symbol $V_E$ shows the potential of the electrode D1.

Other Embodiments

Hereinabove, all embodiments are explained by Examples based on the examination example, but can be applied to ion detection units of any system having a "lead-in electrode" including the second conventional example and the third conventional example.

Each of the embodiments can also be adopted in a composite manner. For example, it is possible to combine the first embodiment (mesh) and the second embodiment (potential difference is small) to make a lead-in electrode into a mesh shape and to set the applied potential to the lead-in electrode to be 500 V application. Moreover, it is possible to combine the first embodiment (mesh) and the fifth embodiment (ring-shaped) to make a lead-in electrode into a mesh shape and a ring shape. The eighth embodiment (shielding case) can be applied to all embodiments with a permissible space such as the fourth to sixth embodiments.

The secondary electron multiplier (SEM) was explained based on a multistage and vertically direction incident type, but other systems (such as a multistage and axis direction incident type, a continuous and vertical direction incident type, and continuous and axis direction incident type) can also be used.

The example, in which the "lead-in electrode" is provided apart from the SEM, was explained, but the "lead-in electrode" and the SEM may be constituted integrally, or may be constituted in a shape in which the "lead-in electrode" is mounted inside the SEM.

It was explained based on that the primary cause of the noise generation is the stray light (vacuum ultraviolet light and soft X ray), but the explanation is effective for all excitation sources (neutral particles, ions, electrons, electromagnetic waves) causing the generation of electrons on an extraction electrode having a negative high potential.

AS the generation place of excitation sources, not only the ion source and the quadrupole electrode, but also other parts of the mass spectrometer such as an aperture board and wiring, and the internal space of the mass spectrometer are also estimated. As a specific example, when an ion collides against an aperture board at a high speed, an ion or soft X ray is generated. Wiring generates an ion or soft X ray by discharge due to overvoltage. In the internal space, the collision of an ion and a residual gas generates an ion or vacuum ultraviolet light.

With regard to the generation place of excitation sources, a disturbance from the outside of a mass spectrometer is also estimated. As an example, there is monitoring of a neutral gas existing inside a plasma apparatus, and, in this case, neutral particles, ions, electrons and electromagnetic waves with a high energy are problematic.

The ion source was explained based on the electron ionization (EI) system, but ion sources of all systems generating an exiting source giving the influence can be applied, including an inductively-coupled plasma (ICP) system, an atmospheric pressure chemical ionization (APCI) and an atmospheric pressure photo ionization (APPI).

The mass spectrometer was explained as having an ion source as a constituent article, but the application is possible also to a mass spectrometer including no ion source and detecting ions generated outside the mass spectrometer. As an example, there is monitoring of ions existing in a plasma apparatus.

The mass spectrometer was explained as of the quadrupole type, but mass spectrometry mechanisms of all the other systems such as a sector type, a TOF type etc. can be applied. Accordingly, the member called the mass aperture board in the explanation is a member generally should be called an exit aperture board of a mass spectrometer.

As described above, the ion detector of the invention is a unit capable of giving a high S/N, and is favorable for various kinds of mass spectrometers for a broad range of applications.

The invention claimed is:

1. An ion detector, comprising:

a secondary electron multiplier having a first-stage electrode generating an electron by collision of an ion, and a rear-stage electrode generating a secondary electron amplified by collision of the electron generated from the first-stage electrode;

a deflecting electrode changing a trajectory of an ion toward the first-stage electrode side; and a lead-in electrode for pulling in the ion the trajectory of which is changed by the deflecting electrode toward the first-stage electrode side, wherein the lead-in electrode has at least one opening so that an area to which internal stray light generated inside the ion detector or external stray light generated outside the ion detector is incident upon becomes small.

2. The ion detector according to claim 1, wherein the lead-in electrode has a mesh shape, a slit shape, or a shape such that a plurality of wires is provided spaced apart from each other.

3. The ion detector according to claim 1, wherein a potential difference between the lead-in electrode and the deflecting electrode is set so that light amount of the internal stray light incident to the first-stage electrode is not more than light amount of the external stray light incident to the first-stage electrode.

4. The ion detector according to claim 1, wherein the lead-in electrode is set to have the same potential as that of the first-stage electrode.

5. The ion detector according to claim 1, wherein a potential difference between the lead-in electrode and the deflecting electrode is smaller than a potential difference between the first-stage electrode and the deflecting electrode.

6. The ion detector according to claim 1, wherein the lead-in electrode has a plurality of electrodes, and a potential difference between the lead-in electrode on a side nearer to the first-stage electrode and the first-stage electrode is smaller than a potential difference between the lead-in electrode on a side farther to the first-stage electrode and the first-stage electrode.

7. The ion detector according to claim 1, wherein the lead-in electrode is provided spaced apart from the first-stage electrode by a predetermined distance on a side of an ion introduction part of the ion detector, and is provided, between the ion introduction part and the first-stage electrode, on a side of the ion introduction part.

8. The ion detector according to claim 1, wherein:

the deflecting electrode is provided at a previous stage of the lead-in electrode in a traveling direction of an ion introduced into the ion detector; and the lead-in electrode is a ring-shaped electrode provided so that an ion passes through an opening of its own electrode.

9. The ion detector according to claim 8, further comprising a second ring-shaped lead-in electrode provided between the ring-shaped lead-in electrode and the deflecting electrode, wherein a potential applied to the second ring-shaped lead-in electrode is a potential for accelerating an ion from the second ring-shaped lead-in electrode to the ring-shaped lead-in electrode.

10. The ion detector according to claim 8, further comprising a ring-shaped electrode provided at a previous stage of the deflecting electrode in a traveling direction of an ion introduced into the ion detector, so that an ion passes through an opening of its own electrode.

11. The ion detector according to claim 1, further comprising a shield case surrounding the secondary electron multiplier, the shield case having an ion introduction part for introducing the ion pulled in by the lead-in electrode into the first-stage electrode.

* * * * *